US007225926B2

(12) United States Patent
Abe

(10) Patent No.: US 7,225,926 B2
(45) **Date of Patent: *Jun. 5, 2007**

(54) CLEANING CONTAINER FOR PHOTOGRAPHIC TREATMENT COMPOSITION

(75) Inventor: Akira Abe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 369 days.

This patent is subject to a terminal disclaimer.

(21) Appl. No.: 10/224,367

(22) Filed: Aug. 21, 2002

(65) Prior Publication Data

US 2003/0111096 A1 Jun. 19, 2003

Related U.S. Application Data

(62) Division of application No. 09/440,133, filed on Nov. 15, 1999, now Pat. No. 6,491,047.

(30) Foreign Application Priority Data

Nov. 13, 1998 (JP) ..... P. 10-323791

(51) Int. Cl.
*B65D 85/84* (2006.01)
*G03C 7/413* (2006.01)

(52) U.S. Cl. ..... 206/524.1; 428/35.7; 430/403; 430/466; 430/497

(58) Field of Classification Search ..... 215/370–373, 215/379–383, 253; 206/524.1; 428/35.7–36.9; 430/403, 466, 497
See application file for complete search history.

(56) References Cited

U.S. PATENT DOCUMENTS 743,155 A 11/1903 Eick
1,492,905 A 5/1924 Swanick
1,492,923 A 5/1924 Knight
1,492,924 A 5/1924 Knight
1,492,957 A 5/1924 Bots
3,690,730 A 9/1972 Sakata et al.
4,168,224 A 9/1979 Jansma
4,567,069 A * 1/1986 Jabarin ..... 428/35.7
4,941,131 A 7/1990 Daly et al.
5,534,317 A * 7/1996 Herman et al. ..... 428/35.7

(Continued)

FOREIGN PATENT DOCUMENTS

JP 61-148250 A 7/1986

(Continued)

*Primary Examiner*—Bryon P. Gehman
(74) *Attorney, Agent, or Firm*—Sughrue Mion, PLLC

(57) ABSTRACT

A method and apparatus for cleaning treatment composition containers are disclosed which are capable of taking out photographic treatment compositions in the form of powder, granules, tablets or slurry from the containers without adhesion of the components to the inner wall of the container and residue of the coagulated and solidified substances and as well as cleaning the inside portions of the containers. The method and apparatus for cleaning the containers for the photographic treatment compositions have the steps of mounting containers filled with treatment compositions in the form of powder, granules, tablets or slurry and comprising as a resin, only high-density polyethylene (HDPE) having a density of 0.941 to 0.969 g/cm$^3$ and a melt index of 0.3 g/10 min to 5.0 g/10 min to a cleaning apparatus; opening an opening portion of the container to inject the treatment material into a dissolving tank, and spraying cleaning water into the empty container from a nozzle.

4 Claims, 7 Drawing Sheets

U.S. PATENT DOCUMENTS

| | | | | | |
|---|---|---|---|---|---|
| 5,573,129 | A | * | 11/1996 | Nagata et al. | 215/382 |
| 5,577,614 | A | * | 11/1996 | Palmeroni et al. | 206/521 |
| 5,578,427 | A | * | 11/1996 | Cullinan et al. | 430/393 |
| 5,582,957 | A | * | 12/1996 | Sirianni et al. | 215/382 |
| 5,640,643 | A | | 6/1997 | Hoitz et al. | |
| 5,737,709 | A | | 4/1998 | Getty et al. | |
| 5,891,608 | A | * | 4/1999 | Hashimoto et al. | 430/458 |
| 5,915,452 | A | | 6/1999 | Conroy et al. | |
| 5,996,600 | A | | 12/1999 | Ostry | |
| 6,020,113 | A | | 2/2000 | Abe | |
| 6,043,007 | A | * | 3/2000 | Abe | 430/403 |
| 6,457,602 | B2 | * | 10/2002 | Uchiyama | 215/382 |

FOREIGN PATENT DOCUMENTS

| | | | |
|---|---|---|---|
| JP | 63-77957 | A | 4/1988 |
| JP | 6-82988 | | 3/1994 |
| JP | 8-220722 | | 8/1996 |
| JP | 08-248606 | A | 9/1996 |
| JP | 8-257428 | A | 10/1996 |
| JP | 09-123253 | A | 5/1997 |
| JP | 9-269574 | | 10/1997 |
| JP | 10-115903 | A | 5/1998 |
| JP | 10-197999 | A | 7/1998 |
| JP | 10-198000 | A | 7/1998 |
| JP | 10-239819 | A | 9/1998 |
| JP | 10-239820 | A | 9/1998 |

* cited by examiner

CLEANING CONTAINER FOR PHOTOGRAPHIC TREATMENT COMPOSITION

This is a divisional of application Ser. No. 09/440,133 filed Nov. 15, 1999 now U.S. Pat. No. 6,491,047; the disclosure of which is incorporated herein by reference.

BACKGROUND OF THE INVENTION

1. Field of the Invention

The present invention relates to a method and an apparatus for taking out a photographic treatment composition from a container to clean the empty container when photographic treatment solution for use in an operation for processing silver-halide color photographic photosensitive material is prepared. More particularly, the present invention relates to a method and an apparatus for cleaning a container filled with a photographic treatment composition such that handling and transportation easiness can be realized, apprehension that contact of the photographic treatment composition with the hand occurring when the photographic treatment composition is dissolved can be eliminated and the state of filling is realized to be adaptable to an automatic developing machine.

2. Description of the Related Art

In general, a process of a silver-halide photographic photosensitive material, for example, a process of a silver-halide color photographic photosensitive material consists of steps for stabilizing an image including a color developing step, a step for removing silver and a cleaning step using water. In each step, solution (called "processing solution") is used which contains one or more types of processing chemicals except for the cleaning step using water. Since each processing solution has a relatively low density, it is improper that manufacture of each solution in a state in which the solution can be used, transportation of the solutions to a processing laboratory and preservation of the same are performed. The reason for this lies in that reduction in the cost and preserving space cannot be realized and easy handling is not permitted. Therefore, so-called rich processing solution is usually delivered which is obtained by filling a container with rich solution arranged to be diluted with water so as to be used.

The process for raising the concentration of the photographic treatment solution in the uniform liquid phase encounters a limitation because of restraint of the solubility and reactions of components. Therefore, the volume and weight cannot satisfactorily be reduced. Hence it follows that a suggestion has been made that the photographic treatment composition is formed into powder, granules, tablets or slurry so as to reduce the volume and the weight.

Although the foregoing method is effective to reduce the volume and the weight, there arises a problem in that collapsed fine particles in the composition in the form of powder, granules, tablets or slurry and coagulated and solidified fine particles adhere to the inner surface of the container and remain on the foregoing surface. A portion of the components of a solid photographic treatment composition, such as the tablets or granules, firmly adheres to the inner surface of the container because of slight moisture adsorption. Thus, the portion cannot easily be removed. The foregoing portion raises a problem from viewpoints of environmental conservation, safety work and recycling of the containers.

It is preferable that the container for the photographic treatment composition is reused to effectively utilize the resources. To achieve the foregoing object, a method has been disclosed in, for example, Japanese Patent Laid-Open No. 8-220722 and Japanese Patent Laid-Open No. 6-82988, the method having the steps of discharging the components from the container; and cleaning the inside portion of the container with water.

When the foregoing method is applied to the components in the form of powder, granules, tablets or slurry such that cleaning water is poured to the solid or slurry particles, local coagulation and solidification occur. Thus, a portion of the component remains in the container and, therefore, the portion cannot easily be discharged from the container. When the components is in the form of the slurry, the particles of the components are introduced into the container. Thus, the slurry components cannot easily be removed by cleaning using water.

When the form of the photographic treatment composition is changed from the rich composition solution in a uniform phase to the components in the form of powder, granules, tablets or slurry, the volume and the weight can be reduced. Thus, easy transportation and handling and cost reduction can be realized. However, the foregoing problems must be overcome.

SUMMARY OF THE INVENTION

An object of the present invention is to overcome problems caused from considerable reduction in the volume of a photographic treatment composition and including adhesion of the components of the photographic treatment composition to a container and formation of coagulated and solidified substances which cannot easily be discharged when the photographic treatment composition in the form of powder, granules, tablets or slurry is taken out from the container to dissolve the photographic treatment composition to prepare a photographic treatment solution and the empty container is cleaned. Specifically, an object of the present invention is to provide a method and apparatus for cleaning a container for a photographic treatment composition in the form of powder, granules, tablets or slurry such that the photographic treatment composition can easily be taken out from the container, adhesion of the components to the wall of the container and remaining of coagulated and solidified substances in the container can be prevented and the inside portion of the container can satisfactorily be cleaned.

To achieve the foregoing objects, the inventor of the present invention has performed a variety of investigations. As a result, the facility of cleaning and removing the substances allowed to adhere to the wall of the container and coagulated and solidified substances considerably depends on the method of cleaning the container and the material of the container. As for the material of the container, a container made of a high-density polyethylene having a density and a melt index satisfying predetermined ranges enables a required cleaning effect to be obtained. A variety of investigation have furthermore been performed on the basis of the foregoing fact. As a result, the present invention has been achieved. That is, the foregoing objects can be achieved by the present invention having the following aspects.

1. A method of cleaning a container for a photographic treatment composition comprising the steps of: taking out a photographic treatment composition from a container to dissolve the photographic treatment composition in water; and cleaning the empty container so as to prepare photographic treatment solution, wherein the photographic treatment composition is in the form of powder, granules, tablets or slurry, the container filled with the photographic treatment composition comprises as a resin, only high-density polyethylene (HDPE) having a density of 0.941 to 0.969 g/cm$^3$ and a melt index of 0.3 g/10 min to 5.0 g/10 min, the container is loaded into a cleaning apparatus, an inlet opening of the container is opened, the photographic treatment composition is injected into a dissolving tank, and cleaning water is sprayed to the inside portion of the empty container so as to clean the container.

2. A method of cleaning a container for a photographic treatment composition according to aspect 1, wherein the container for the photographic treatment composition is manufactured by blow molding using high-density polyethylene (HDPE) having a liquidity ratio of 20 to 30.

3. A method of cleaning a container for a photographic treatment composition according to aspect 1 or 2, wherein the operation for cleaning the inside portion of the container by spraying cleaning water is repeated spray cleaning which is performed such that spraying of cleaning water is performed plural times to perform intermittent spraying.

4. A method of cleaning a container for a photographic treatment composition according to any one of aspects 1 to 3, wherein cleaning water which has been used to clean the inside portion of the container is used as a portion or the overall portion of water for dissolving the photographic treatment composition.

5. A container for a photographic treatment composition arranged to be cleaned by the method of cleaning a container for a photographic treatment composition according to any one of aspects 1 to 4, the container for a photographic treatment composition comprising: an opening through which the photographic treatment composition is discharged; a cover or a sealing member for closing the opening; a bottom formed opposite to the opening; a columnar portion sandwiched between the opening and the bottom to substantially accommodate the photographic treatment composition; and a shoulder portion for joining the columnar portion and the opening, wherein the container is formed such that (1) a surface of projection of the columnar portion on the surface of the bottom is in the form of a rectangle or a square having a long side, the length of which is 40 mm to 100 mm and a ratio of a short side with respect to the long side is 0.7 to 1.0 or a circle having an inner diameter of 40 mm to 100 mm, (2) a ratio of the height of the columnar portion with respect to the long side or the inner diameter is 2.0 times to 4.0 times, and (3) an angle of inclination (an angle made from the surface of the bottom) of the shoulder portion made from the columnar portion to the opening is 15° to 45°.

6. An apparatus for cleaning a photographic treatment composition such that the photographic treatment composition is taken out from a container for the photographic treatment composition to dissolve the photographic treatment composition in water and the empty container is cleaned, the apparatus for cleaning a photographic treatment composition comprising: a dissolving tank, wherein the photographic treatment composition is in the form of powder, granules, tablets or slurry, the container filled with the photographic treatment composition comprises as a resin, only high-density polyethylene (HDPE) having a density of 0.941 to 0.969 g/cm$^3$ and a melt index of 0.3 g/10 min to 5.0 g/10 min, the container is loaded into the cleaning apparatus, an inlet opening of the container is opened, the photographic treatment composition is injected into the dissolving tank, and cleaning water is sprayed to the inside portion of the empty container so as to clean the container.

The photographic treatment composition applied to the structure of the present invention is a composition in the form of powder, granules, tablets or slurry. The photographic treatment composition is characterized in that its volume is considerably reduced as compared with a usual photographic treatment composition in a uniform liquid phase. The disadvantage of the foregoing photographic treatment composition is that the reduction in the volume causes substances allowed to adhere to the wall of the container and coagulated and solidified substances which cannot easily be discharged to be produced. An essential portion of the present invention is that contrivances of the combination of the characteristics of the material of the container and the method of cleaning the container enable the foregoing substances to be removed.

The container for use in the cleaning method according to the present invention and capable of easily removing substances allowed to adhere to the wall of the container and coagulated and solidified substances by injection cleaning comprises as a resin only one resin component. The resin is high-density polyethylene (herein after called "HDPE") having a density of 0.941 to 0.969 g/cm$^3$ and a melt index of 0.3 g/10 min to 5.0 g/10 min. It is preferable that the density is 0.951 to 0.969 g/cm$^3$, more preferably 0.955 to 0.965 g/cm$^3$. It is preferable that the melt index is 0.3 g/10 min to 4.0 g/10 min. The melt index is a value obtained by a measuring method conforming to ASTM D1238 under conditions that the temperature is 190° C. and the load is 2.16 kg. Hereinafter the values of the melt index are those obtained by the above-mentioned conditions.

The container comprises as a resin only HDPE means a structure that the body of the container comprises as a resin only HDPE. Although it is preferable that the cap and sealing member of the container are made of the same material as that of the body of the container from a viewpoint of reusing of the material of the container, the foregoing structure is not always required.

In addition to the foregoing density and the melt index, the liquidity ratio of the HDPE is 20 to 30. When the foregoing material is used to perform the blow molding method for manufacturing the container, adhesion to the wall of the container can furthermore be prevented. In the foregoing case, a satisfactory result can be obtained. If the liquidity ratio is lower than 20, the smoothness of the surface of the molded container deteriorates. Therefore, a large quantity of unsolved substances adheres to the wall of the container. If the liquidity ratio is higher than 30, the glossiness of the surface of the container deteriorates. In this case, an estimation is made that the surface has been roughened.

The liquidity ratio is a value obtained by dividing a drift velocity (a melt flow velocity) of the resin measured by a method conforming to ASTM D1238 under conditions that the temperature is 190° C. and the load is 11200 g with a drift velocity measured under the conditions that the temperature is the same and the load is 1120 g.

When the inside portion of the container is cleaned by spraying water, a single spraying operation for continuously spraying cleaning water in a predetermined quantity is not employed. The cleaning operation is performed by the repeated spray cleaning which is performed such that spraying of cleaning water is performed plural times to perform intermittent spraying. In this case, substances allowed to adhere to the wall of the container can considerably effectively be removed. When the intermittent spraying operation is performed three or more times, an effective result can be obtained. It is preferable that the number of spraying operations is three to ten times. It is preferable that the quantity of water which is sprayed in each of the spraying operations is 5 ml to 100 ml. If a multiplicity of spraying operations in each of which the quantity is 5 ml or smaller are performed (intervals of spraying are shortened) or if a small number of spraying operations is performed in each of which the quantity is 100 ml or smaller, a satisfactory effect of cleaning cannot be obtained as compared with the method in which the intermittent cleaning is not employed. The overall quantity of cleaning water may arbitrarily be determined if the quantity is smaller than the quantity of water which is added to the photographic treatment composition which is used to prepare processing solutions, such as replenishers, in the dissolving tank. It is preferable that the overall quantity of cleaning water is 50 ml to 500 ml. Water in a quantity corresponding to the difference between the quantity of diluting water required to prepare the replenisher by diluting the photographic treatment composition and the quantity of cleaning water is directly added to the inside portion of the dissolving tank.

The solidifying agent and dispersed slurry are usually allowed to adhere to the portion in the vicinity of the opening of the container when the composition is discharged from the container. Therefore, it is preferable that the portion in the vicinity of the opening is sprayed with water to clean and remove substances allowed to adhere to the foregoing portion.

A preferred apparatus for cleaning the treatment material according to the present invention is an apparatus for automatically cleaning the treatment material, in which a mounting portion for the container for the treatment material is provided at the upper portion. The container for the treatment material is mounted to the mounting portion such that the opening of the container faces downwards. Thus, the photographic treatment composition in the container is discharged into the dissolving tank. After the discharge has been completed, a flow of water injected through a nozzle inserted through the downward opening is used to clean the inside portion of the empty container.

An automatic developing apparatus where the above-mentioned preferred apparatus for cleaning the treatment material is integrated and the dissolving tank also serves as a replenisher accumulating tank is a concrete embodiment of the present invention. The apparatus for cleaning the treatment material may be provided independently from the developing apparatus.

The phenomenon that fine particles and/or coagulate substances adhere to the wall of the container and the phenomenon that substances are coagulate and solidified occur apparently in the following case: the photographic treatment composition contains alkali metal carbonate, such as potassium carbonate or sodium carbonate; alkali metal hydroxide, such as potassium hydroxide or sodium hydroxide; alkali metal sulphite; alkali metal borate; alkali metal thiosulfate; ammonium thiosulfate; color developing agent or black and white developing agent, such as hydroquinone. Therefore, the present invention is significantly effective when the components contains the foregoing chemicals.

Other objects, features and advantages of the invention will be evident from the following detailed description of the preferred embodiments described in conjunction with the attached drawings.

DESCRIPTION OF THE PREFERRED EMBODIMENTS

Figure 1:
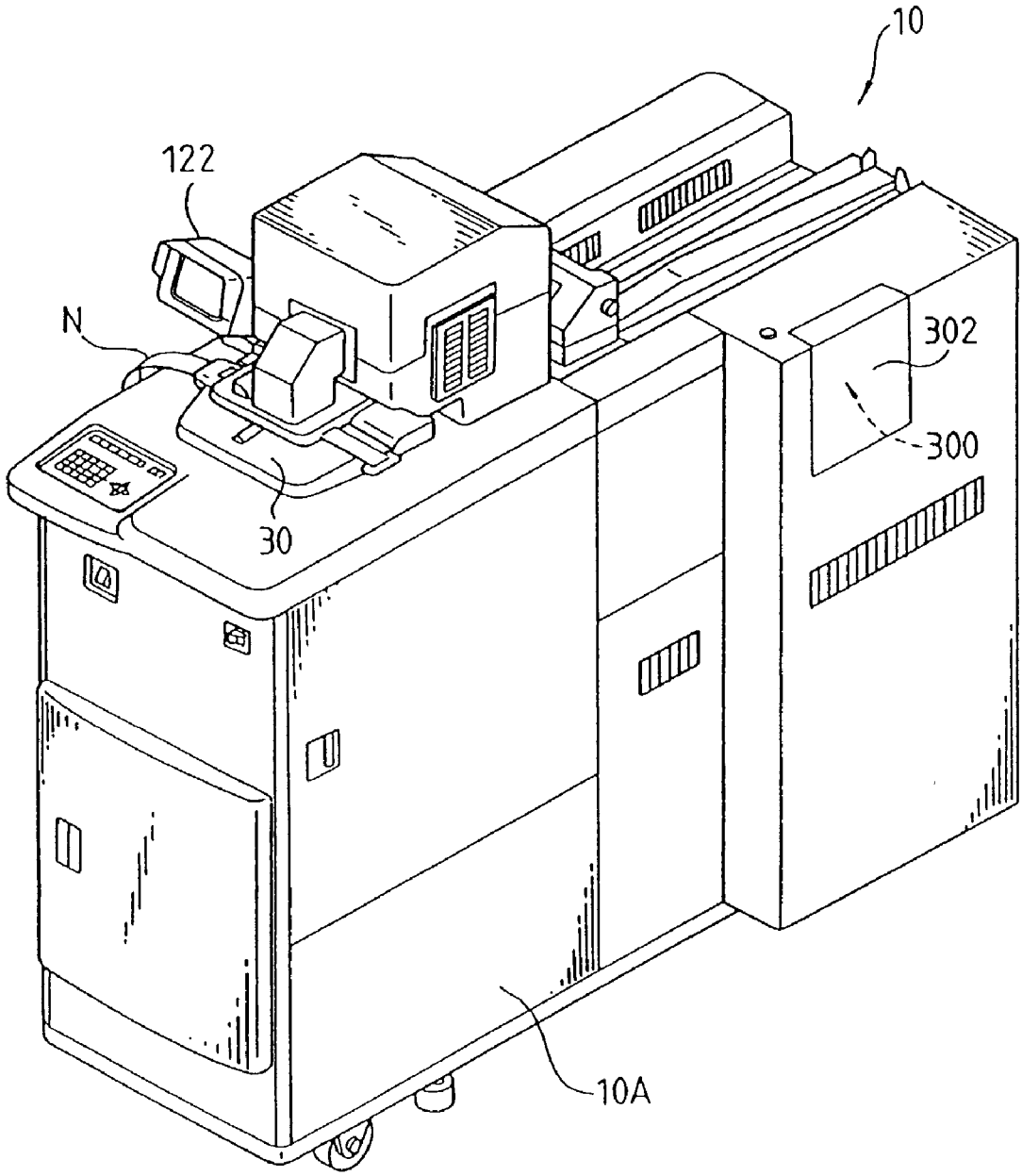
FIG. 1 is a perspective view showing a printer processor on which an apparatus for dissolving a photographic treatment composition according to an embodiment of the present invention has been mounted.

An embodiment of the present invention will now be described.

Photographic Treatment Composition

A photographic treatment composition according to the present invention is a component in the form of powder, granules, tablets or slurry prepared by a known method.

A portion of the powder photographic treatment composition can be charged into a container by mechanically mixing raw material in the form of powder. If simple mixing is performed which causes a problem of preservation stability to arise, a known method may be employed with which the components are divided into one or a plurality of groups (for example, a color developing agent and alkali carbonate), mixture of which with anther component must be avoided and groups, the mixture of which with another component is permitted (for example, alkali carbonate, alkali bicarbonate and borate). Then, the components in each group are mixed with one another, followed by sequentially charging the single components and the mixed components into the container so that a powder photographic treatment composition in the form of a laminated structure is prepared.

When the photographic treatment composition is a granular composition, chemicals which are raw material are directly mixed with one another or mixed with a proper binder by a method disclosed in, for example, Japanese Patent Laid-Open No. 4-221951 and Japanese Patent Laid-Open No. 2-109043. Then, a granulating operation is performed. The granulation and mixing of the chemicals of the photographic treatment composition are performed depending on the granulating method. In accordance with the structure of the composition, granulation is performed such that the compositions are sectioned into a component group which must solely be granulated and a component group which must be granulated after proper components have been mixed with one another. After the components have been granulated, the granules are simply mixed with one another. As an alternative to this, the above-mentioned layered structure is formed which is enclosed in the container. Thus, the treatment material containing granules is prepared.

The granulating method may be a spray and drying granulating method which has the steps of spraying the component chemicals or solution of the chemical groups of the photographic treatment agent through a spray nozzle; and evaporating water. The environment in which the spraying operation is performed is sometimes an inert gas atmosphere, such as nitrogen, depending on the characteristics of the processing chemicals.

The average particle size of the granulated particles is 100 μm to 3000 μm to correspond to the type of the granulated particles. The size of the particles is controlled by the concentration of the photographic treatment chemical solution, the caliber of the spraying nozzle and the spraying pressure. The treatment chemical solution may be added with a proper binder according to the type of the chemical. A preferred binder is sugars, such as starch, dextrine or saccharose, water-soluble polymer, such as polyethylene glycol, polyacrylic amide or polyacrylic acid having a molecular weight of 4000 to 20000, acrylic amide, acrylic acid, methacrylic acid or a copolymer obtained by combining their anion dielectric monomer (for example, 2-acrylic amid-2-methylpropane sulfonic acid) and cation dielectric monomer (for example, N-vinyl benzil-N,N,N-trimethyl ammonium chloride) with each other. Another granulating method may be employed with which a binder selected from the above-mentioned materials in a small quantity is added to the powder photographic treatment chemical to be kneaded so as to perform granulation. It is usually preferable that the quantity of the binder which must be added is 50 mg to 500 mg per 1 kg of the treatment chemical.

Another granulating method may be employed with which the powder photographic treatment chemical is solely or the chemicals are mixed with one another. Then, the chemical or the chemicals are kneaded with water in a small quantity, followed by forming a thread shape material by operating an extruder. Then, the surface of the material is heated to dehumidify and dry the material, followed by grinding the material to have an average particle size of 0.5 mm to 1 mm. Then, the material is dried under reduced pressure or normal pressure so as to sufficiently perform dehydration. It is usually preferable that the foregoing binder is added to the obtained mixture. The binder may be added before grinding and mixing of the chemicals. As an alternative to this, the binder may be added to the solution after grinding and granulation have been performed, the addition being performed in a step before a final drying step. Either of the method is selected depending on the substances which must be granulated.

When the photographic treatment composition is in the form of the tablets, the raw material chemicals of the component are directly mixed or mixed with a proper binder. Then, the mixed material is press-molded to form the tablets. Whether or not the single treatment chemical is formed into the tablets or a plurality of chemicals which can be mixed with one another are mixed to form the tablets is determined depending on the method of designing the treatment material similarly to the granulating method.

The known methods have been disclosed in, for example, Japanese Patent Laid-Open No. 5-119450, Japanese Patent Laid-Open No. 51-61837 and Japanese Patent Laid-Open No. 54-155038. Also in the foregoing case, the above-mentioned method when the granulation is performed is basically employed with which the single or the mixed chemical groups are brought to a bound state owing to originally contained water or water added in a small quantity. Then, the chemicals in the bound state is loaded into a pressure granulating machine so as to be formed into the tablet. It is preferable that the ground treatment chemical which is applied with pressure so as to be formed into the tablet contain moisture by 0.1% to 2.0%, more preferably 0.5% to 1.5%. The foregoing binder described in the granulation step is added to the bound treatment chemicals depending on the type of the mixed chemicals prior to the process for applying pressure to form the chemicals into the tablets. The quantity of the binder to be added is determined to satisfy the above-mentioned range which is the same as the quantity permitted to be added when the granulating step is performed.

The chemicals which are formed into the tablet are not limited to the treatment chemical in the powder state. The particle chemicals granulated by the above-mentioned method may be contained. In the foregoing case, the granules are changed to the tablet shape. Therefore, the chemicals is protected double by the granulation and the formation into the tablet.

The slurry liquid composition will now be described. When the concentration of the liquid composition is raised, unsolved substances, that is, slurry, is formed if the quantity of water for dissolving the components of the treatment material is too small to realize the solubility of the treatment material component. If the unsolved substances stably exist and addition of water causes dissolution to occur to form a uniform phase, the composition can be used similar to the rich liquid treatment material. Therefore, a slurry treatment composition having a furthermore reduced volume as compared with the rich liquid treatment material can be obtained. The degree of condensation of the slurry treatment material composition is 2.0 times to 50 times, preferably 3 times to 20 times when it is expressed with a dilution ratio (a volume ratio) which is employed when the composition is diluted with water to prepare required treatment solution.

A preferred method of manufacturing the slurry composition will now be described. A combination with which the sectioning of the components into a single or specific component groups enables rich solution in a uniform phase is selected if the manufactured treatment composition is the insoluble dispersed substances in the solid form, that is, the slurry. Then, rich solutions of the component chemical groups are rapidly mixed in a state of considerable stirring to deposit suspensions in the form of particles. In the foregoing case, the solvent for the rich solution of each of the component chemical groups which must be mixed with one another is not limited to water. The solvent may be solvent obtained by mixing a proper organic solvent. For example, the concentration of the color developing agent serving as the liquid treatment composition in the uniform phase cannot be raised because of the limitation of the solubility (for example, the concentration is limited to 0.02 mol/litter to 0.04 mol/litter with the pH and ion strength of a usual color developing replenisher). When the slurry developing treatment composition is manufactured, adjustment of the pH enables uniform solution having a concentration of 1 mol/litter to be prepared. When the foregoing rich color developing agent solution is rapidly mixed with another rich component solution, a slurry composition exhibiting satisfactory dispersion characteristic can be obtained. The satisfactory dispersion characteristic means that the dispersed substances are not coagulated during preservation of the treatment agent and, therefore, a stable state of dispersion is maintained. When water is added when the composition is used, solution in a uniform phase can be obtained.

The method of manufacturing the slurry treatment composition has been disclosed in U.S. Pat. No. 2,735,774 and U.S. Pat. No. 2,784,086.

As described above, the treatment composition in the form which is any one of powder, granules, tablets or slurry can be prepared by the known method.

Container

The material of the container for the treatment composition will furthermore be described.

Material

The effect of the present invention contrary to expectations can be obtained, that is, any substance cannot easily adhere to the wall of the container and a satisfactory cleaning operation can be performed because insoluble coagulated and solidified substances can relatively easily be discharged if the foregoing substances are formed. The foregoing effect can be obtained when the container is made of HDPE which satisfies the density, the melt index and preferably the above-mentioned liquidity ratio. The foregoing effect cannot be obtained if the container is made of a general-purpose plastic container made of a material except for HDPE, such as low-density polyethylene (LDPE), polypropylene, polyethylene terephthalate (PET) or polyvinyl chloride (PVC). If the container is made of HDPE having the treatment chemical and melt index which do not satisfy the above-mentioned ranges, the foregoing effect cannot be obtained. To reuse the container, the polyethylene container has an advantage that the method of recovering and reusing the waste plastic has most satisfactorily been established and, therefore, the cost required to reuse it can be reduced.

It is preferable that the HDPE container having an excellent dimension accuracy required for the container for the treatment composition is manufactured by the blow molding method. More particularly, when an injection blow molding method is employed, a furthermore excellent dimension accuracy can be maintained. It is preferable that drawing is performed in addition to the injection blow molding method. In the present invention, the container manufactured by the molding method on the basis of the blow molding method and cleaning which is performed by the water spraying method are employed to improve the cleaning performance. The reason for this lies in that the smoothness of the surface of the wall of the container and the orientation of the polymer molecules exert influences on the foregoing effect. To manufacture the polyethylene container having a size of about 0.2 litter to 5.0 litters suitable to the present invention by the injection blow molding, it is preferable that the HDPE which satisfies the above-mentioned density and the melt index. Moreover, it is preferable that also the liquidity ratio satisfies the foregoing range.

If necessary, the HDPE may be added with pigment, such as carbon black, titanium white, calcium silicate or silica, which does not exert an adverse influence on the alkali developing composition; an additive, such as calcium carbonate or 2,6-di-t-butyl-4-methylphenol (BHT); a known oxidation inhibitor, such as dicetyl sulfide, tris (laurylthio) phosphite, another amine material, a thioether material or a phenol material; a skid, such as stearic acid or its metal salt; a known ultraviolet absorber, such as 2-hydroxy-4-n-octyloxibenzophenone, having compatibility with polyethylene; or a known plasticizer having compatibility with polyethylene. It is preferable that the total quantity of the foregoing additives is not larger than 50% of the total quantity of the mixture of the plastic raw material. It is preferable that the ratio of polyethylene (HDPE) is 85% or higher and no plasticizer is contained, more preferably the ratio of polyethylene (HDPE) is 95% or higher and no plasticizer is contained.

The cap of the container is not required to be HDPE. The cap may be made of LDPE. If the cap is made of HDPE, the HDPE is not required to have the density and the melt index which are the same as those of the HDPE of the body of the container. Therefore, HDPE having a proper grade can be selected which facilitates the operation for molding the cap and which meets the required airtightness of the fitting portion with the opening of the body of the container. The material of the cap may be made of HDPE and only the sealing portion of the cap, that is, only the portion which is fitted to the opening of the body of the container may be made of LDPE having a density of 0.91 to 0.94 g/cm$^3$. The above-mentioned use of LDPE in a small quantity does not exert an adverse influence on the reusing of polyethylene.

According to another aspect of the present invention, the cap which is fitted to the opening is omitted; and the opening is sealed with a polyethylene plate or an aluminum sheet in which an opening can be formed. The foregoing container does not require the cap.

Shape of Container

The characteristics of the material of the container for the photographic treatment composition are as described above. The shape of the container will now be described. A preferred shape of the container according to the present invention comprises: an opening through which the photographic treatment composition is discharged; a cover or a sealing member for closing the opening; a bottom formed opposite to the opening; a columnar portion sandwiched between the opening and the bottom to substantially accommodate the photographic treatment composition; and a shoulder portion for joining the columnar portion and the opening, wherein a surface of projection of the columnar portion on the surface of the bottom is in the form of a rectangle or a square having a first side, the length of which is 40 mm to 100 mm and a ratio of a second side with respect to the first side is 0.7 to 1.0 or a circle having an inner diameter of 40 mm to 100 mm, a ratio of the height of the columnar portion with respect to the first side or the inner diameter is 2.0 times to 4.0 times, and an angle of inclination (an angle made from the surface of the bottom) of the shoulder portion made from the columnar portion to the opening is 15° to 45°. When the dimensions and the shape are satisfied, the handling facility and easy mounting to a representative mini-lab developing machine can be realized. Moreover, the inside portion of the container can easily and satisfactorily be cleaned after the developer composition has been discharged.

The lengths of the long side and second side realized on the surface of projection of the columnar portion on the bottom do not include the thickness of the columnar portion. That is, the foregoing lengths are inner first and second sides.

When a plastic bottle is molded, the cross sectional shape which is in the form of an accurate square or rectangular cannot be formed. In the foregoing case, the shape has rounded corners. Therefore, the cross sectional shape of the container in this specification which is the "square" or the "rectangle" must be described as "substantially square" or "substantially rectangle". That is, the term "substantially" must be added. In this specification, the term "substantially" is omitted.

The angle of inclination of the shoulder portion made from the columnar portion to the opening includes two angles which are an angle of the shoulder portion made from the columnar portion to the opening and an angle of the shoulder portion made from the second when the columnar portion is formed into a square pole. In the present invention, it is preferable that both of the two angles of inclination satisfy the range from 15° to 45°.

The preferred length of the first side is 50 mm to 90 mm, more preferably 60 mm to 80 mm. A preferred ratio of the second side with respect to the first side is 0.8 to 1.0, more preferably 0.9 to 1.0 and most preferably 0.95 to 1.0. When the container is a cylindrical container, a preferred inner diameter is 50 mm to 90 mm, preferably 60 mm to 80 mm.

The ratio of the height and the first side or the inner diameter is 2.0 to 4.0. If the ratio is lower than 2.0, the area which is cleaned with water in a predetermined quantity which downwards flows along the inner wall of the container is reduced. Moreover, the impact pressure is undesirably lowered. As a result, a satisfactory cleaning effect cannot be obtained. That is, the container cannot satisfactorily be cleaned with water in a limited quantity.

If the ratio is higher than 4.0, the effect of cleaning the highest portion in the container (the bottom of the container) deteriorates. To satisfactorily clean the container, water pressure must be raised. Therefore, low-cost cleaning cannot be performed. Hence it follows that the above-mentioned ratio of the height and the inner diameter or the first side must be satisfied to most effectively clean the container with the limited quantity of water. It is furthermore preferable that the ratio is 2.5 to 3.5.

The angle of inclination of the shoulder portion made from the columnar portion to the opening (the angle made from the bottom) must be 15° to 45° from a viewpoint of smooth flow of the substances allowed to adhere to the surface, more preferably 20° to 40° and most preferably 25° to 35°.

It is preferable that the opening has the opening portion, the inner diameter of which is larger than ½ of the diameter or the length of one side of the cross section of the container and not longer than 95% of the inner diameter or the one side.

When the container for the developer composition satisfies the above-mentioned conditions, only a small quantity of water is required to clean the container in which no substance remains.

To realize easy handling and easily mounting of the container to the developing machine, a large-size container having a size larger than the above-mentioned dimensions requires a large-size cleaning pump and spraying nozzle which are not suitable for a processing laboratory installed in a shop. A small-size container having an inner diameter or a first side smaller than the above-mentioned dimensional range requires a large quantity of material for the container per unit volume. Thus, cost cannot be reduced. What is worse, easy handling cannot be performed and satisfactory adaptation to the apparatus cannot be realized. From a viewpoint of obtaining an effect of cleaning and removing color substances allowed to adhere to the inner wall of the container obtainable from combination of the thickness and the material to be described later, the foregoing small-size container is not a preferred container.

Structure of Apparatus for Cleaning Container for Treatment Composition

Structure of Cleaning Apparatus

Embodiments of the method and apparatus for discharging the treatment composition to clean the empty container will now be described. The effect of the present invention can be improved when the apparatus for dissolving the treatment composition provided with an apparatus for cleaning the container for the treatment composition is mounted on a developing apparatus. Therefore, an embodiment of the foregoing structure will now be described.

FIG. 1 is a perspective view showing a printer processor on which the apparatus for dissolving the treatment composition provided with an apparatus for cleaning the container for the treatment composition according to the present invention has been mounted. A left-half portion 10A serves as a printer portion, while a right-half portion serves as a processor portion.

Figure 4:
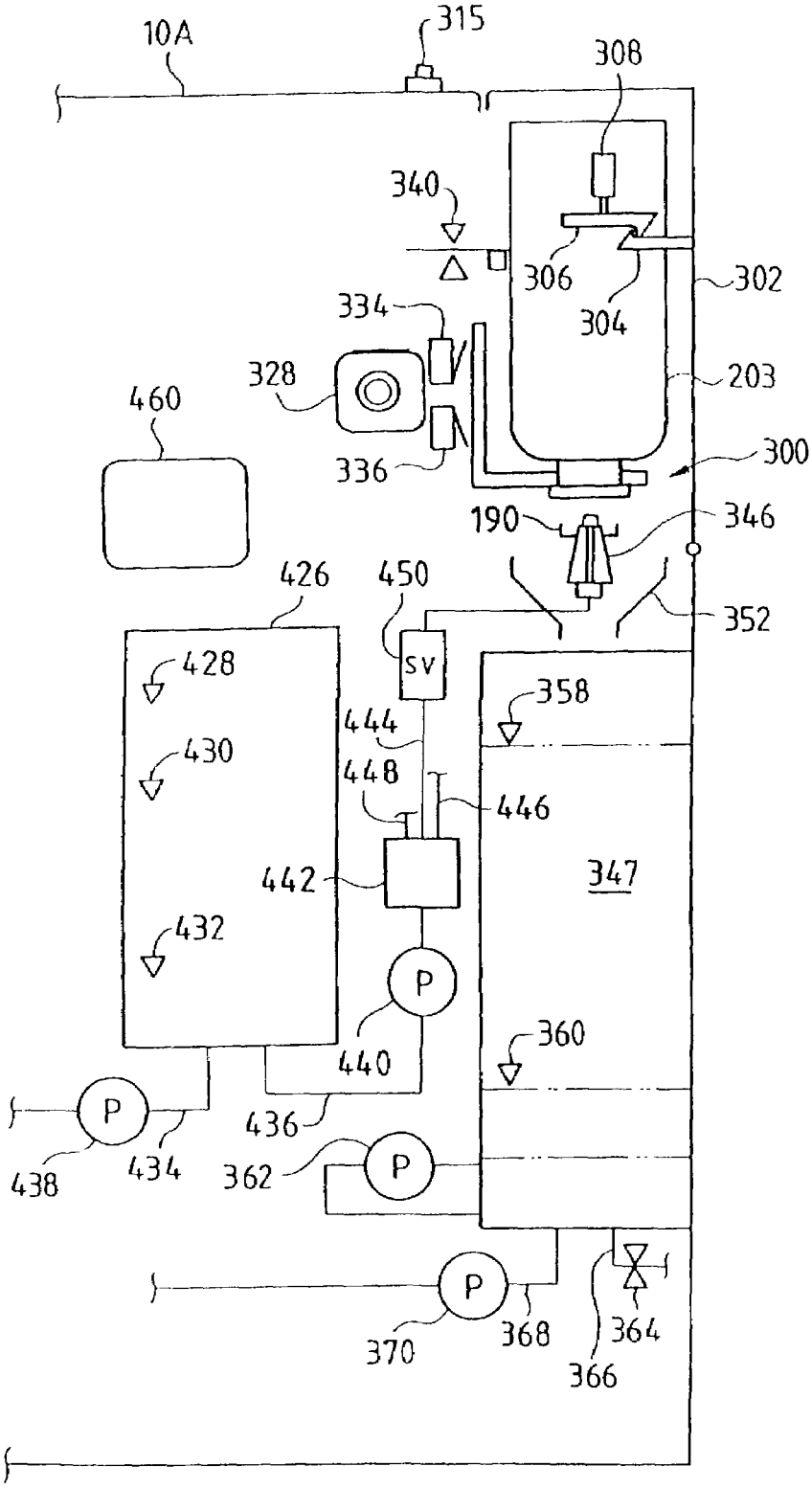
FIG. 4 is a diagram showing the structure of a developing apparatus, on which the dissolving apparatus has been mounted which incorporates a portion on which a treatment material is mounted, a portion from which the composition is taken out and a replenisher tank also serving as the dissolving tank.

FIG. 4 is a schematic side view showing the internal structure of the right-hand portion of the processor portion, in which a loading portion into which a treatment material cartridge has been loaded, a replenisher dissolving tank also serving as an accumulating tank, a tank for storing water for the dissolving operation and the cleaning operation and their pipe systems.

The apparatus for dissolving the treatment composition is mounted on the printer processor and constituted by a portion for mounting the container for the treatment material, the apparatus for cleaning the container for the treatment material and the dissolving tank. The portion 300 (on the inside of an opening/closing door 302) for mounting the container for the treatment material is formed in the upper-half portion of the apparatus for dissolving the treatment composition, the portion 300 being formed above the printer processor. The apparatus for cleaning the container for the treatment material is disposed below the printer processor. The dissolving tank is disposed below the apparatus for cleaning the container for the treatment material. In this embodiment, the dissolving tank also serves as the tank for accumulating replenisher. Each tank filled with each of the treatment composition required in the developing process is collectively accommodated in an accommodating case to facilitate handling. The foregoing accommodating case is called a treatment material cartridge. Each treatment composition in the form of the treatment material cartridge is mounted to the portion 300 for mounting container for a treatment material, the opening/closing door 302 of which is only shown in FIG. 1 showing this embodiment.

Figure 2:
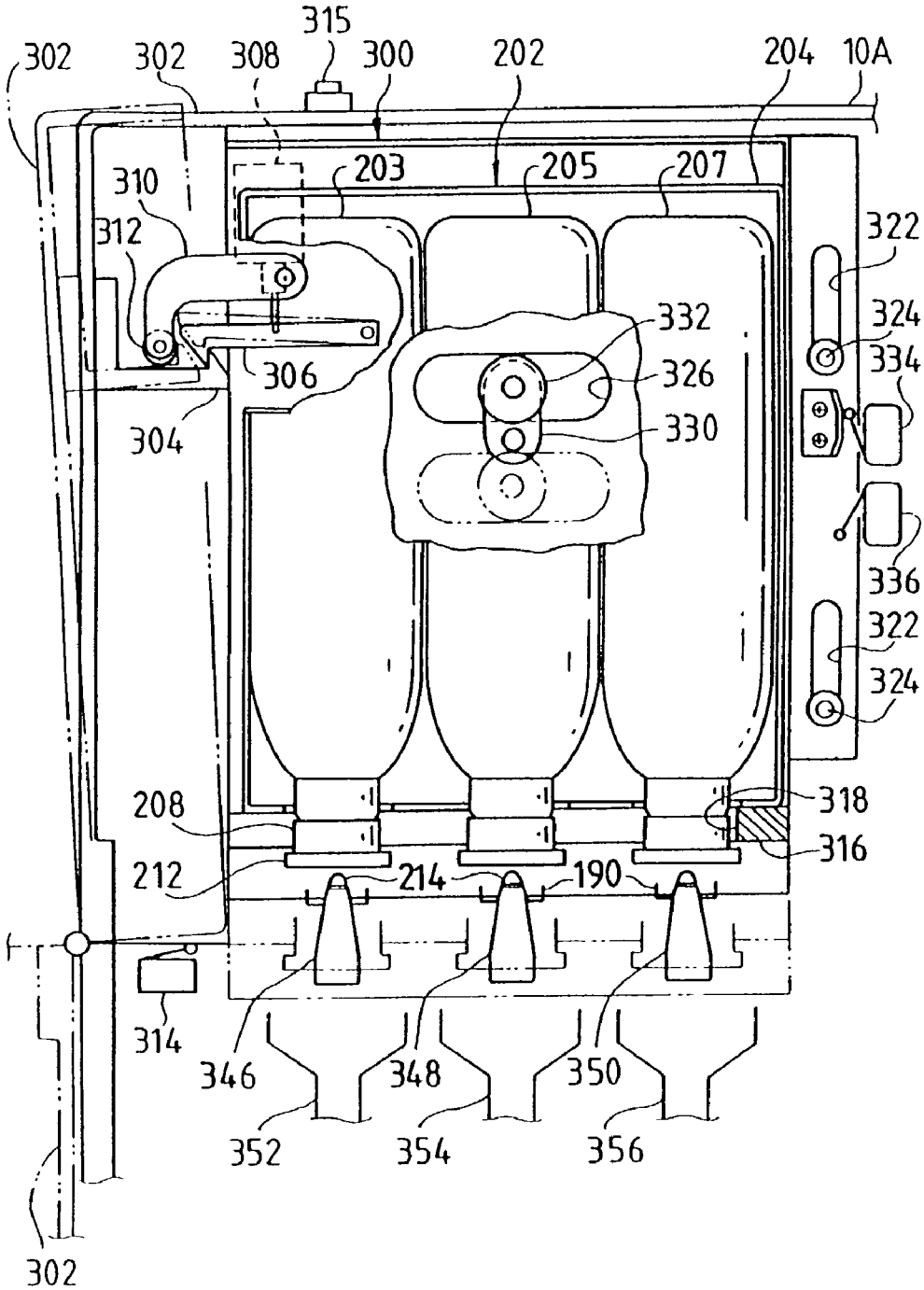
FIG. 2 is a front view showing a portion in the printer processor on which a cartridge collectively accommodating three containers for the photographic treatment compositions has been mounted.

FIG. 2 shows a state in which a treatment material cartridge 202 has been held by a holder 316 which is accommodated in the portion 300 for mounting container for a treatment material. In this embodiment, a container 203 for developer composition, a container 205 for bleach composition and a container 207 for fixer constitute the treatment material cartridge 202 accommodated in a collective accommodating case (a corrugated fiberboard) 204. A treatment material outlet portion is formed which incorporates opening and cleaning members 346, 348 and 350 corresponding to the photographic treatment compositions each having a cleaning nozzle (214 shown in FIG. 2 or FIG. 5) and an opening blade (190 shown in FIG. 2 or FIG. 5) below an opening (1300 shown in FIG. 7). Moreover, funnels 352, 354 and 356 are disposed below the treatment material outlet portion. A replenisher accumulating tank also serving as a dissolving tank (347 shown in FIG. 4) for the photographic treatment composition is disposed through the funnel 352. A replenisher accumulating tank also serving as a dissolving tank for the bleach composition (not shown) and a replenisher accumulating tank also serving as a dissolving tank for the fixer (not shown) are disposed below the funnels 354 and 356. As shown in FIG. 4, when the opening and cleaning member 346 (the opening and cleaning members 348 and 350 not shown in FIG. 4 have the same structure as that of the opening and cleaning member 346) has opened the container having the opening facing downwards, the treatment material in the container is discharged to the above-mentioned replenisher accumulating tanks also serving as dissolving tanks. Thus, the treatment material in the container is discharged. Also cleaning water which has cleaned the container from which the treatment material has been discharged is introduced.

Figure 3:
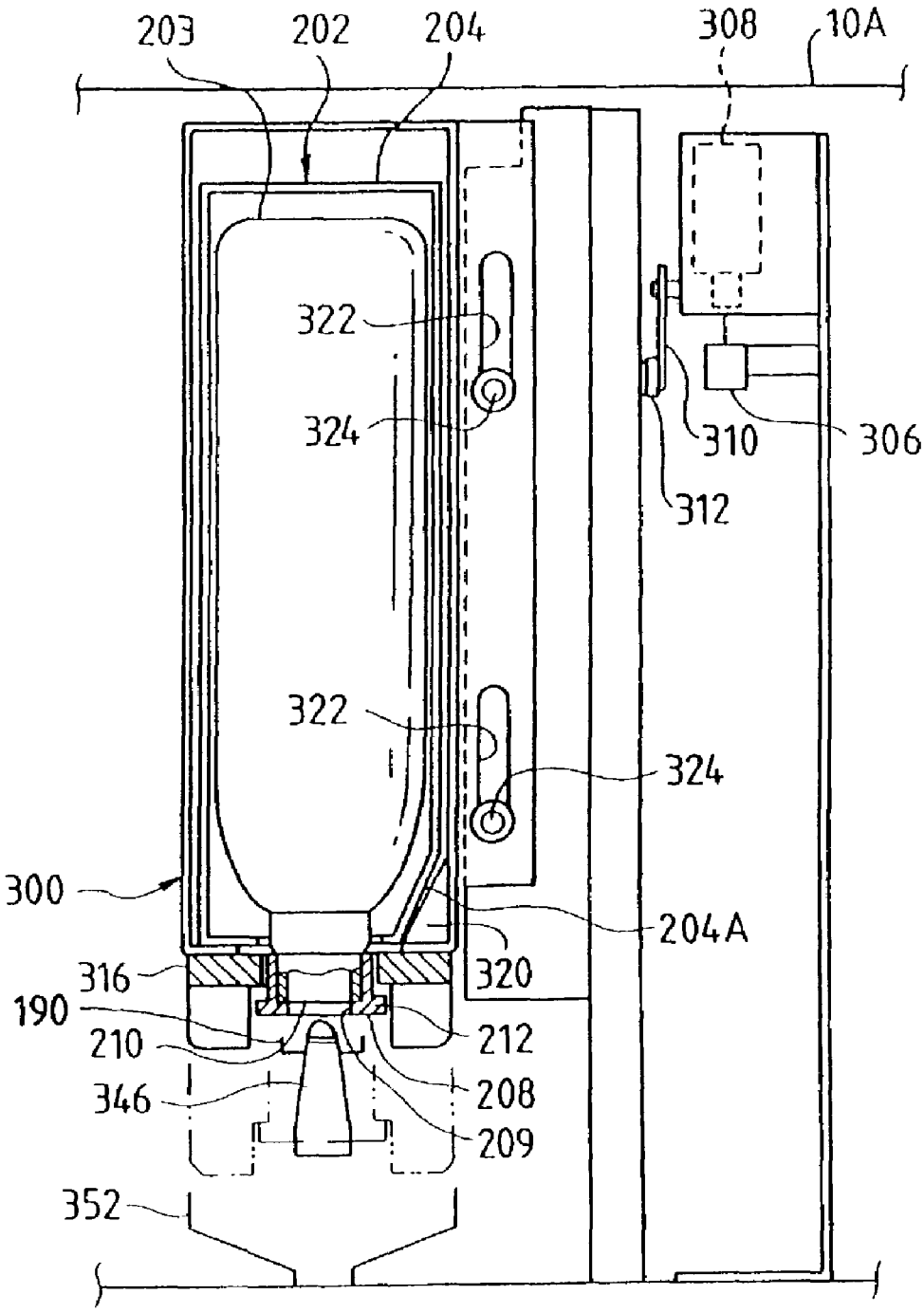
FIG. 3 is a side view showing a portion in the printer processor on which the cartridge of the containers for the photographic treatment compositions corresponding to FIG. 2 has been mounted.

FIG. 3 is a side view corresponding to FIG. 2 and showing each container for the treatment material, the structure of the accommodating portion and the relationship among the accommodating portion and the peripheral members in the treatment material cartridge shown in FIG. 2. Since the three apparatuses for dissolving the treatment materials have the same structures, the apparatus for dissolving the developer substances will mainly be described.

Figure 5:
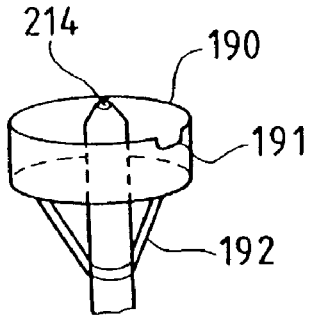
FIG. 5 is a perspective view showing opening and cleaning member according to the embodiment of the present invention and incorporating a shaft portion provided with a cleaning nozzle and an annular opening blade formed around the shaft portion.

FIG. 5 is a perspective view showing the opening and cleaning member (346 shown in FIG. 2) according to this embodiment. The cleaning nozzle 214 is disposed adjacent to the leading end of the central shaft portion of the opening and cleaning member 346. An opening blade 190 in the form of a short cylindrical shape is secured to the portion around the shaft by a support column 192. The opening blade has a sharp upper end formed into the blade shape to cut and open the sealing member when the opening blade has been brought into contact with the sealing member of the container. Moreover, the opening blade has a groove 191 to prevent complete cutting and opening of the sealing member which causes the sealing member to be separated and allowed to fall from the opening. The leading end of the shaft incorporating the cleaning nozzle 214 has the same height as that of the opening blade. The height is determined in such a manner that the operation of the opening blade to cut and open the sealing member is not obstructed if the opening blade is first brought into contact with the sealing member or the leading end of the shaft is first brought into contact with the sealing member. The relationship between the two elements is determined in such a manner that the opening blade portion does not block sprayed water when cleaning water is sprayed.

Figure 6:
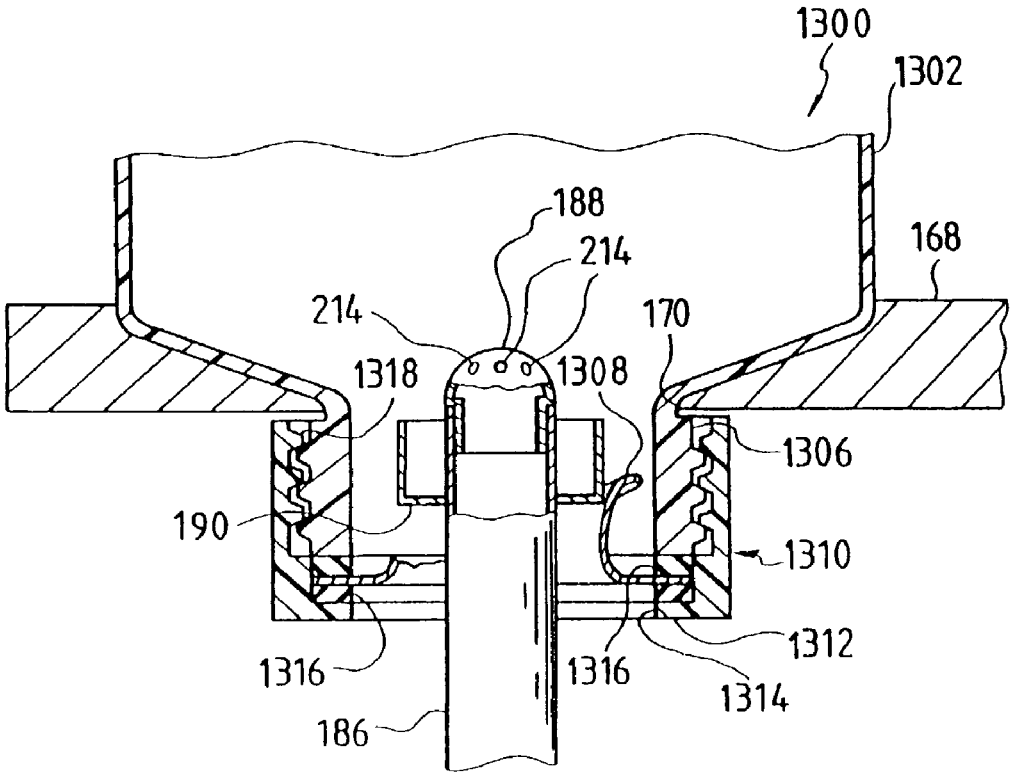
FIG. 6 is a diagram showing a state in which the opening and cleaning member has opened the container for the photographic treatment composition and the opening and cleaning member has been introduced into the container.

On the other hand, the bottle is loaded into the replenishing portion of the developing machine in a state in which the bottle is upside down. The opening and cleaning member approaches the opening of the bottle so that the opening blade 190 secured to the opening and cleaning member cuts the aluminum sheet member (308 shown in FIGS. 6 and 1308 shown in FIG. 7) from a lower position. Thus, the treatment composition in the bottle is introduced into the replenishing tank.

FIG. 6 shows a state in which the opening blade 190 has cut the aluminum sheet 308 (1308 shown in FIG. 7) The treatment composition in the bottle is discharged so as to be introduced into the replenishing tank. Then, cleaning water is sprayed through a spraying opening formed in the cleaning nozzle 214 provided for the opening and cleaning member so that the inside portion of the container is cleaned. Also discharge cleaning water is introduced into the replenishing tank so that discharged cleaning water is used as a portion of diluting water for preparing the replenisher from the treatment material.

Container for Treatment Composition According to Embodiment

In this embodiment, the treatment composition is a slurry composition. The container 203 for developer composition shown in FIG. 2 is filled with the developer composition in a quantity of 500 ml, the container 205 for bleach composition is filled with the bleach composition in a quantity of 500 ml and the container 207 for fixer is filled with the fixer in a quantity of 500 ml.

In a dissolving tank 347 shown in FIG. 4, diluting water in a quantity of 4500 ml is added to 500 ml of the developer composition so that the replenisher (in a quantity of 5000 ml as the prepared solution) is prepared. In the two other dissolving tanks (not shown), diluting water in a quantity of 1500 ml is added to each of the bleaching composition and the fixer composition, the quantity of each of which is 500 ml Thus, the bleach replenisher and the fixer replenisher (in a quantity of 2000 ml as each of prepared solution) are prepared. Each diluting water contains cleaning water for the container from which the contents have been discharged.

If the treatment composition is in the form of granules, tablets or powder, the cleaning apparatus according to this embodiment can be employed such that granules, tablets or powder is substituted for the slurry composition.

The structure of the bottle 1300 which is the container for the photographic treatment agent will now be described with reference to FIG. 7. The bottle 1300 has a body 1302. The body 1302 of the bottle 1300 according to this embodiment is formed into a hollow prismatic shape. The upper end of the body 1302 is tapered so that its diameter is gradually reduced. Moreover, an opening 1306 is formed which has an outer surface in which a male thread 1304 is formed. The upper end of the opening 1306 is opened so that discharge of the composition through the opening is permitted. Note that an aluminum sheet 1308 serving as the sealing member is fitted to the upper end of the opening 1306 so that the upper end is sealed until the contents of the bottle 1300 is used. It is preferable that the aluminum sheet 1308 has corrosion resistance by laminating a polyethylene film. The polyethylene film also has a function to thermally weld the aluminum sheet to the opening.

The bottle 1300 has a cap 1310 which is a fixing member. The cap 1310 is formed into a cylindrical shape opened toward the opening 1306 of the body 1302 of the container. A female thread 1318 corresponding to the male thread 1304 formed in the opening 1306 is formed in the inner surface of the cap 1310. Thus, engagement to the opening 1306 is permitted. When engagement to the opening 1306 has been established, the inside portion of a upper bottom 1312 of the cap 1310 and the opening 1306 of the body of the container sandwich the aluminum sheet 1308 so as to be secured to the opening 1306. Therefore, a circular opening 1314 sealed with the aluminum sheet 1308 is formed in the bottom 1312 of the cap 1310. The aluminum sheet 1308 sealing the opening can be opened in a state in which the fitted cap 1310 is remained. In this embodiment, the aluminum sheet 1308 is welded to the opening of the body of the container with the laminated polyethylene film. The sealing member may be clamped and secured between an upper bottom 1312 and the opening of the body of the container by an annular packing 1316.

Operation of Embodiment

The operation of this embodiment will now be described with mainly reference to FIG. 4 and also referring to FIGS. 2 and 5 to 7.

When the level in the replenishing tank 347 also serving as a dissolving tank has been made to be lower than a predetermined level as the developing process proceeds, the foregoing fact is detected by a float switch 360. Thus, supply of the replenisher composition into the replenishing tank 347 also serving as a dissolving tank and preparation of the replenisher are displayed on a monitor 460.

Referring to FIG. 4, when a control unit 460 (which is the same as the monitor 460) has been operated in a state where the bottle 203 has been loaded on the mounting portion, a motor 328 is rotated. Thus, the overall body of the mounting frame is downwards moved together with the slide member (324 shown in FIGS. 2 and 3). Thus, the opening and cleaning member 346 is moved to approach the bottle 203, followed by passing the cleaning member 346 through the opening (1314 shown in FIG. 7) of the cap (1310 shown in FIG. 7) so as to be brought into contact with the aluminum sheet (1308 shown in FIG. 7).

Figure 7:
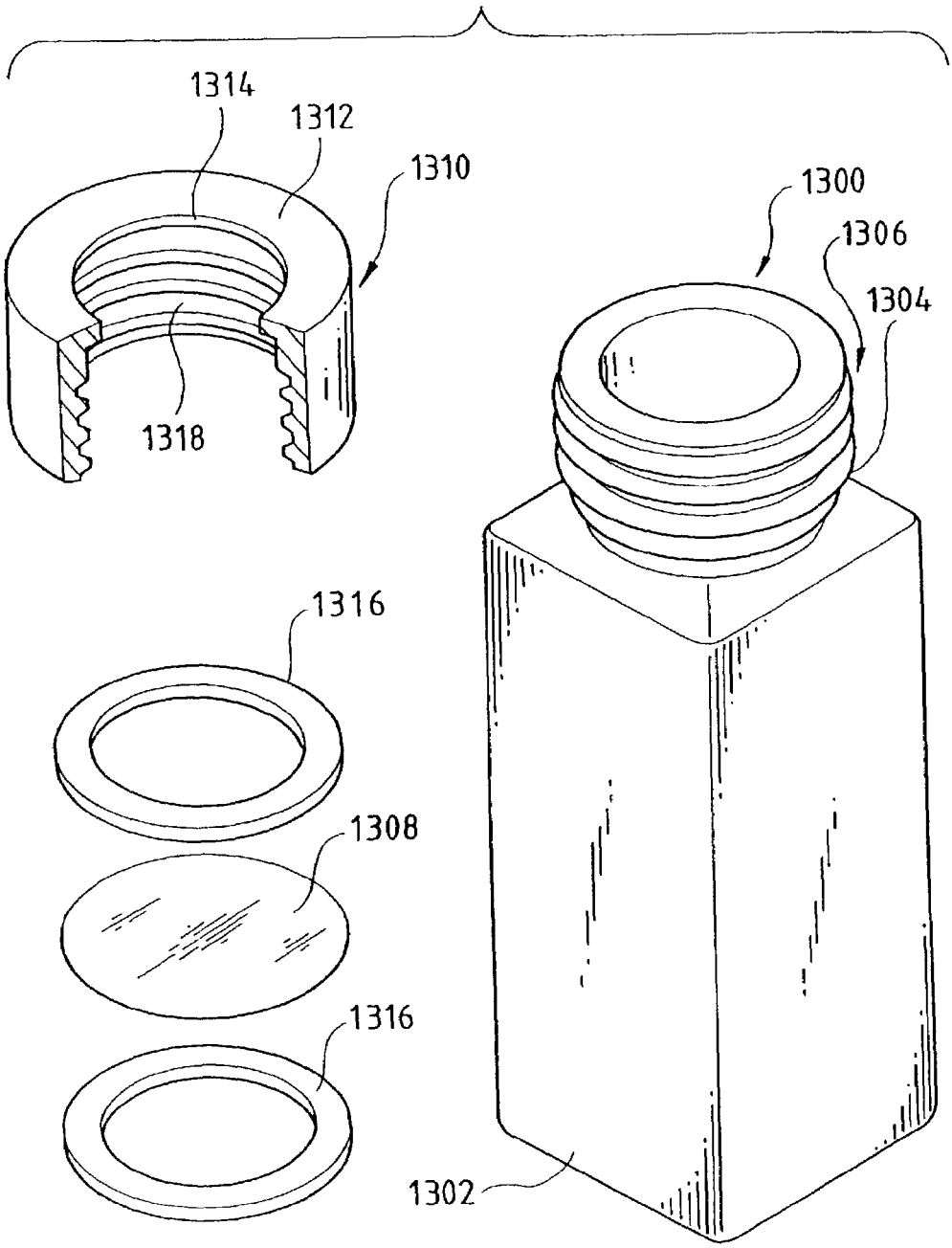
FIG. 7 is an exploded perspective view showing a container for the photographic treatment composition according to the embodiment of the present invention.

In the foregoing state, the rotational force of the motor 328 causes the opening and cleaning member 346 to furthermore be allowed to approach the aluminum sheet (1308 shown in FIG. 7). Thus, the opening blade 190 provided for the opening and cleaning member 346 breaks the aluminum sheet (1308 shown in FIG. 7) so that the aluminum sheet (1308 shown in FIG. 7) is opened. As a result, the treatment composition (the developer replenisher) in the body (1302 shown in FIG. 7) of the container is discharged. In a case of the powder or the granules which is the treatment composition, discharge may be facilitated by providing a mechanism for vibrating the holder which is holding the treatment material kit.

After a predetermined time (time required for the treatment material to be discharged from the container and previously stored in the control unit 460) has elapsed in the foregoing state, a pump 440 is operated. Thus, a switching cock 442 is switched, causing an electromagnetic valve 450 to be opened. Thus, cleaning water is sprayed to the inner wall of the container from a water storage tank 426 through the cleaning nozzle 214 provided for the opening and cleaning member 346.

Cleaning and Cleaning Water

The mechanism and operation for cleaning the inside portion of the container will now be described such that the side for supplying cleaning water is described. As shown in FIG. 4, a water storage tank 426 in which cleaning water (diluting water) for dissolving and diluting the treatment material (condensed suspension) is stored is provided.

As shown in FIG. 4, a casing 10A includes a water storage tank 426 for accumulating cleaning water and dissolving and diluting water. Pipes 436 (one of the pipes is shown as an example) for supplying water to the cleaning nozzle (214 and the like) of an opening and cleaning member 346 (348 and 350 shown in FIG. 2) are connected to the bottom of the water storage tank 426. Water in the water storage tank 426 passes through the pipe 436, a water supply pump 440 and a switching cock 442 so as to be supplied to an electromagnetic valve 450. Then, a leading end is supplied to the cleaning nozzle 214 so that the container 203 from which the treatment material has been discharged is cleaned. Similarly, two other water supply pipes branched from the switching cock 442 are used to supply water to corresponding cleaning nozzles through corresponding electromagnetic valves. Thus, the containers 205 and 207 from which the treatment materials have been discharged are cleaned. Thus, the treatment compositions are discharged from the containers, and then cleaning water is sprayed from each cleaning nozzle to the inside portion of each empty container so that the container is cleaned.

At this time, the electromagnetic valve 450 and the pump 440 are intermittently operated so that intermittent spraying of cleaning water from the cleaning nozzle (214 shown in FIGS. 5 and 6) is permitted. When cleaning water is continuously sprayed, cleaning water sprayed upwards and cleaning water which falls interfere with each other. Thus, the cleaning effect sometimes deteriorates. The intermittent spraying is able to prevent the foregoing problem. Hence it follows that the cleaning efficiency can be improved.

It is preferable that the intervals of the intermitting spraying is made to be one second or longer, cleaning water can preferably be discharged to the outside of the container between the spraying operations.

If the discharging pressure from the pump 440 can be changed, changing of the discharging pressure is permitted. Also in the foregoing case, a satisfactory effect similar to the intermittent spray of cleaning water can be obtained. If the discharging pressure from the pump 440 cannot be changed, a variable-pressure valve which is controlled by the control unit 460 may be employed.

To efficiently clean the container, the spraying angle (θ: an angle made between a direction of spraying and a perpendicular surface), the dimensions of the treatment material container and the aspect ratio are important factors. When the treatment material container is in the form of a prismatic container and an assumption is made that the second side (the inner side) of the columnar portion is A and the first side (the inner side) of the same is B, it is preferable that B/A=1 to 1.5. More preferably, A=B. Assuming that the height of the inside portion of the container (the height from the opening of the inverted container to the bottom) is C, it is preferable that A<C and B<C. More preferably C/A=2 to 5. When the columnar portion of the container is in the form of a cylinder, it is preferable that the height C of the inside portion of the container with respect to the diameter (the inner side) A' of the cross section of the columnar portion satisfies C/A'=2 to 5.

The spraying angle (θ) must be 60° or smaller. It is preferable that the spraying angle is 10° to 50°, more preferably 15° to 45°. If the spraying angle is too large, the upper portion of the container cannot easily be cleaned. If the spraying angle is too small, impact against the wall of the container is too weak to effectively clean the container.

Assuming that the height from the opening of the inverted container at the position at which the lower end portion of the cleaning solution which is sprayed to the inner surface of the container is made contact with the inner wall of the container is C1, it is preferable that C1 is not larger than ½. It is preferable that the absolute value of the foregoing height is 100 mm or smaller, more preferably 70 mm or smaller and most preferably 50 mm or smaller.

It is preferable that supply of cleaning solution to the cleaning nozzle 214 is performed such that a quantity of 5 ml to 100 ml is sprayed in each spraying operation and the spraying operation is performed 3 times to 10 times.

In this embodiment, the opening of the cleaning nozzle is disposed to spray cleaning water, the opening being in the form of an inverted conical shape. A plurality of small openings facing a variety of directions may be formed to spray cleaning water at a variety of spraying angles.

Cleaning water used to clean the container flows along the wall of the container to downwards flow from the opening to the outside portion of the container. Then, cleaning water is introduced into the dissolving tank 347 (also the other treatment compositions are discharged into the corresponding dissolving tanks) so as to be used as a portion of diluting water.

To prevent clogging of the spraying opening of the nozzle from which cleaning water is sprayed occurring when the container is cleaned, it is preferable that cleaning water is deionized water.

The treatment composition downwards discharged from the bottle (1300 shown in FIG. 7) and cleaning water which has cleaned the inside portion of the container and, in some cases, the portion in the vicinity of the opening are introduced into the dissolving tank 347 through the pipe and the like. In this embodiment, an operator simply opens the opening/closing door 302 to set the bottle (1300 shown in FIG. 7) (usually in the form of the accommodating case collectively accommodating the developer composition kits). Then, the operator closes the opening/closing door 302, and then rotates the motor 328 shown in FIG. 4. The operations for opening the seal, discharging the composition from the container and introducing the composition into the dissolving tank, that is, the operation for opening the aluminum sheet (1308 shown in FIG. 7) to introduce the treatment composition into the dissolving tank 347 is performed on the inside of the closed mounting portion 300 of the processor portion. Therefore, a complicated operation for the operator to hold the bottle (1300 shown in FIG. 7) by the hand is not required. As a result, flying of the replenisher occurring when the replenishment is performed which contaminates the hand or the clothes can be prevented.

The extracted empty bottle (1300 shown in FIG. 7) is recycled. In the foregoing case, the cap (1310 shown in FIG. 7) is removed from the opening (1306 shown in FIG. 7) of the body (1302 shown in FIG. 7) of the bottle (1300 shown in FIG. 7). Then, the aluminum sheet (1308 shown in FIG. 7) is removed. Thus, recovery for each material can be performed. In accordance with the similarity of the materials, materials except for the aluminum sheet (1308 shown in FIG. 7) may collectively be recovered as HDPE. In this embodiment, attached elements are provided which are the body (1302 shown in FIG. 7) of the container (1300 shown in FIG. 7), the cap (1310 shown in FIG. 7), the aluminum sheet (1308 shown in FIG. 7) and packings. In the foregoing case, elements including the above-mentioned attached elements are independent elements which are assembled so that the container is constituted. Therefore, when the cap (1310 shown in FIG. 7) is removed from the body (1302 shown in FIG. 7) of the container (1300 shown in FIG. 7), the elements, including the aluminum sheet (1308 shown in FIG. 7), can easily be removed and separated. When the aluminum sheet (1308 shown in FIG. 7) is directly secured to the opening 1306, there is apprehension that the aluminum sheet (1308 shown in FIG. 7) is broken and left. However, the foregoing problem can be prevented so that the labor is saved. Another structure may be employed in which the aluminum sheet (1308 shown in FIG. 7) is secured to the opening and the cap (1310 shown in FIG. 7) is omitted. A plastic plate made of LDPE or the like may be substituted for the aluminum sheet 1308 shown in FIG. 7. In the foregoing case, also the sealing member can be recycled as well as the body of the container. Since the quantity of the plastic plate is small as compared with the quantity of the HDPE of the body of the container, fractional recycling is not required.

Figure 8:
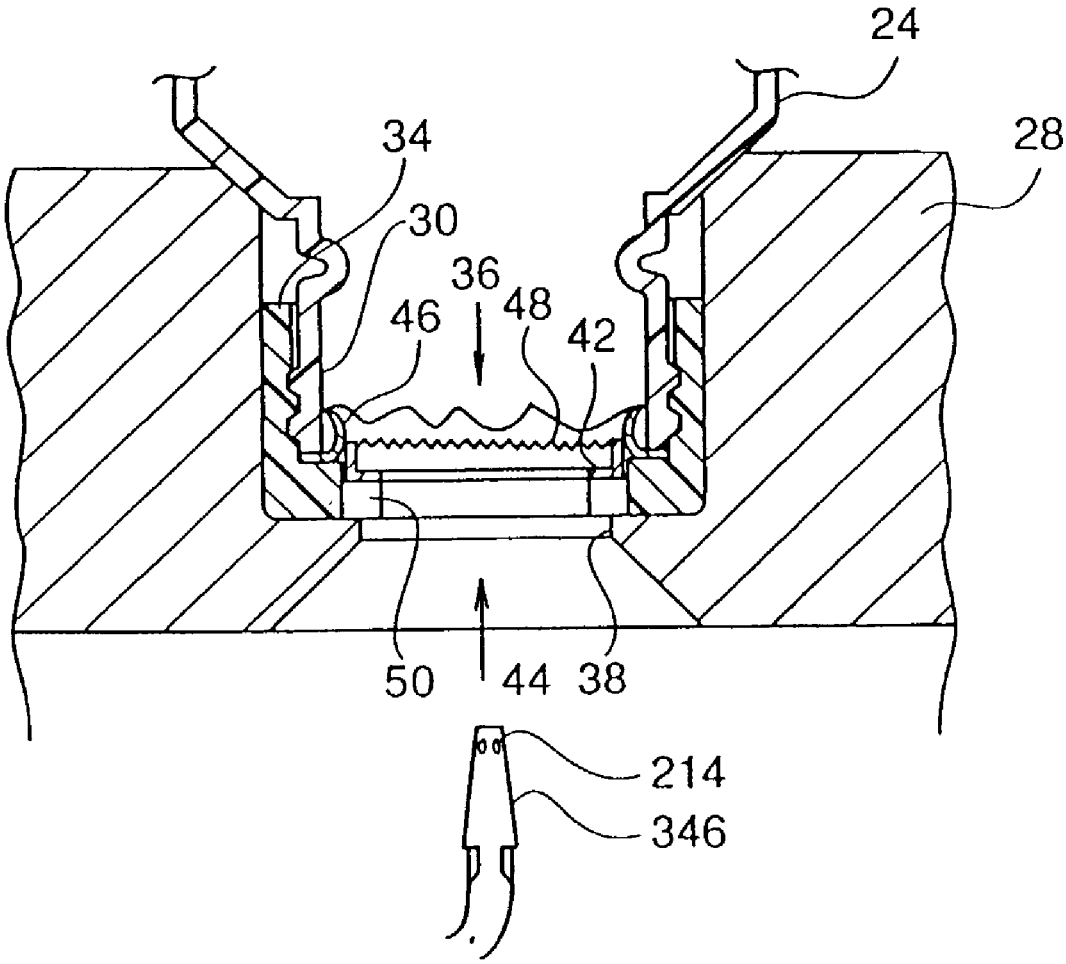
FIG. 8 is a diagram showing a state in which the opening member according to the embodiment of the present invention has opened the container for the photographic treatment composition and before a container cleaning step is started.

FIG. 8 shows another example of an opening method according to the present invention and distinct from the sealing method described with reference to FIGS. 4 to 6. FIG. 8 shows a state in which a container 24 filled with powder composition and made of HDPE has been mounted on a frame 28 for holding the cleaning apparatus such that the opening of the container 24 faces downwards. That is, the cap opening operation has been completed. A neck 30 which is a discharge opening of the container 24 on the frame 28, a seal 46 (already broken in a state shown in FIG. 8) for sealing the opening at the upper end of the neck 30 and a cylindrical outer cap 34 surrounding the neck 30 constitute an injection/discharge opening 36.

A thread is formed in the inner wall of the outer cap 34 so as to be engaged to a thread formed in the outer surface of the neck 30. An injection opening 38 in the form of a through hole is formed in the upper end surface of the outer cap 34. The upper bottom of the outer cap 34 projects into a flange toward the inside portion of the end of the opening of the injection opening 38. A cylindrical pushing member 42 is accommodated in the injection opening 38 such that the cylindrical pushing member 42 is made contact with the upper bottom.

A through hole 44 is formed in the central portion of a region surrounded by the pushing member 42, the through hole 44 being allowed to communicate with the injection opening 38. A saw-like blade portion 48 is disposed below (adjacent to the tank 12) the seal 46 arranged to seal the injection/discharge opening 30 and made of polyethylene. When the container has been loaded, the seal 46 (a cut section is shown in FIG. 8) can be cut.

A cylindrical member 50 projects over the surface of the bottom of the injection/discharge opening 36 to communicate with the tank 12. The outer diameter of the cylindrical member 50 is smaller than the inner diameter of the injection opening 38 and larger than the diameter of the through hole 44 of the pushing member 42. Thus, the cylindrical member 50 can be introduced into the injection opening 38 to upward move the pushing member 42.

A cleaning member 346 incorporating a cleaning nozzle 214 for spraying cleaning water and a water introducing pipe is disposed above the tank 12 and below the through hole 44 (in this embodiment, apart from the lower end of the through hole 44 for 10 cm). Cleaning water is supplied to the water introducing pipe from a water storage tank (not shown). A water supply pump and an electromagnetic valve (not shown) are disposed between the water storage tank and the cleaning nozzle. A control unit (not shown) instructs vertical movement of the cleaning member and the operations of the water supply pump and the electromagnetic valve. The opening and cleaning member 346 is movably mounted by virtue of a sliding member which is moved by a motor so that the vertical movement of the opening and cleaning member 346 is permitted. When the opening and cleaning member 346 has been moved upwards, the opening and cleaning member 346 is able to pass through the through hole 44 so as to be introduced into the container.

A mechanism for cleaning the photographic treatment agent according to this embodiment will now be described. As shown in FIG. 8, the container 24 is set to the injection opening 36 in a state in which the outer cap 34 remains and the discharge opening 30 of the container 24 faces downwards. Thus, the pushing member 42 is brought into contact with the cylindrical member 50 so that the cylindrical member 50 is pushed upwards toward the seal 46. Thus, the blade portion 48 of the pushing member 42 cuts the seal 46. Hence it follows that the treatment material in the container 24 is introduced into the tank 12 through the through hole 44 of the pushing member 42 and the central portion of the cylindrical member 50.

After the composition in the container 24 has been introduced, the control unit causes the opening and cleaning member 346 to be moved upwards to upwards pass through the through hole 44 so as to be introduced into the container. Then, cleaning water is sprayed from the cleaning nozzle into the inside portion of the container so that the container is cleaned. The cleaning operation may be the continuous spraying operation or the intermittent spraying operation which is arranged such that spraying is performed plural times as described above.

Therefore, requirement for opening the container 24 can be eliminated and contamination of the hand can be prevented. Since the container held in the frame 28 is inserted, powder of the treatment chemical does not fly.

Thus, the preferred structure of the present invention arranged such that the treatment material container is mounted on the automatic developing apparatus has been described. The present invention is not limited to the foregoing automatic-opening-type treatment-solution preparing and replenishment developing process.

Components of Treatment Composition

As described above, the treatment compositions to which the method of dissolving the treatment composition and the dissolving apparatus according to the present invention are applied are the black and white and color treatment compositions in the form of powder, granules, tablets or slurry. The components of each of the composition will now be described.

The treatment compositions are the developing treatment composition (also called a "developer composition"), the bleaching composition and the fixer composition each having the bleaching function and/or the fixing function. Moreover, additional treatment baths including a stabilizing bath as a substitute for water cleaning and an image stabilizing bath exist. The method and apparatus according to the present invention may be applied to the treatment materials for the above-mentioned baths. Since the stabilizing bath as a substitute for water cleaning and the image stabilizing bath use very lean solutions, the foregoing solutions are not the subject of the present invention.

Structure of Developing Treatment Composition

The developer composition is a composition containing a usual black and white or color developer and components contained in the foregoing replenisher solution and formed into the powder, granules, tablets or slurry. The color developer composition contains 4-amino-3-methyl-N-ethyl-N-(β-hydroxyethyl) aniline, 4-amino-3-methyl-N-ethyl-N-(β-methanesulfoamidethyl) aniline or their salt or other p-phenylenediamine type color developing agent. In recent years, a portion of the black and white photosensitive materials include a material in which a coupler for developing black is previously added to form a black and white image by using a usual and general purpose coloring developer. The coloring developer composition according to the present invention may be applied to the treatment of the photosensitive material of the foregoing type.

The black and black and white developer composition includes black and white developing agents represented by hydroquenone, 1-phenyl-3-pyrazolidone type developing agent, erisorbic acid, its derivative, p-aminophenol derivative, such as N-methyl-p-aminophenol and their salts.

The color developing composition contains one or more materials selected from hydroxyamine derivative and sulfurous acid ions depending on the type of the employed photosensitive material. Moreover, an inorganic preservative or an organic preservative may be contained in the foregoing color developing composition. The preservatives may be included in an independent part as a substitute for including of the same in the developer part having a single structure. The organic preservatives are organic compounds each of which reduces the deterioration rate of aromatic primary amine developing agent, that is, organic compounds each having a function to prevent oxidation of the color developing agent owing to air and so forth. Among the foregoing organic compounds, any one of the following organic preservative may be employed: hydroxyamine derivative, such as mono or dialkylhydroxylamine, except for the above-mentioned organic compounds, an alkoxyamino compound, hydroxamic acid, hydrazide, phenol, α-hydrokyketone, α-aminoketone, saccharides, monoamine, diamine, polyamine, quaternary ammonia, nitrokyradicals, alcohols, oxime, diamide compounds and condensed ring amine.

Moreover, any one of the following preservative may be employed if necessary: a variety of metal materials disclosed in Japanese Patent Laid-Open No. 57-44148 and Japanese Patent Laid-Open No. 57-53749, salicylic acid disclosed in Japanese Patent Laid-Open No. 59-180588, alkanol amine disclosed in Japanese Patent Laid-Open No. 54-3532, polyethylene imine disclosed in Japanese Patent Laid-Open No. 56-94349 and aromatic polyhydroxy compounds disclosed in U.S. Pat. No. 3,746,544. Alkanol amine, such as triethanol amine except for the above-mentioned material, may be added.

Cycloamine disclosed in Japanese Patent Laid-Open No. 63-239447, amine disclosed in Japanese Patent Laid-Open No. 63-128340 amine disclosed in Japanese Patent Laid-Open No. 1-186939 and Japanese Patent Laid-Open No. 1-187557 may be contained.

The black and white and the color developer composition may be added with chlorine ions, bromine ions or iodine ions, is necessary. Since halide ions are discharged into the developing solution as by-products of the developing operation, they are not usually necessary for the developer substances which must be replenished.

It is preferable that the black and white and the color developing solution has pH of 9.5 or higher, preferably 10.0 to 12.0, more preferably 10.1 to 11.5. Therefore, the pH of the developer composition is designed to cause the color developer and the replenisher for the development which are prepared from the developer composition to have the above-mentioned pH. To stably maintain the pH, it is preferable that a buffer is employed. The buffer may be any one of the following materials: carbonate, phosphate, borate, tetraborate, hydroxybenzoate, salt of N,N-dimethylglycine, salt of leucine, salt of norleucine, salt of guanine, salt of 3,4-dihydroxyphenylalanine, salt of alanine, aminobutyrate, 2-amino-2-methyl-1,3-propane diol salt, valine salt, proline salt, salt of trishydroxyaminomethane and lycine salt. In particular, each of the carbonate, phosphate, tetraborate and hydroxybenzoate has excellent buffering performance in a high pH region not lower than 9.0. Therefore, advantages can be realized in that any adverse influence (fogging or the like) is not exerted on the photographic performance if the foregoing material is added to the color developer and the foregoing material is a low-cost material. Therefore, the above-mentioned material is employed in the developer composition.

Specifically, the buffer may be any one of the following materials: sodium carbonate, potassium carbonate, sodium bicarbonate, potassium bicarbonate, tertiary sodium phosphate, tertiary potassium phosphate, disodium phosphate, dipotassium phosphate, sodium borate, potassium borate, sodium tetraborate (borax), potassium tetraborate, o-hydrxy potassium benzoate, 5-sulfo-2-hydroxy sodium benzoate (5-sodium sulfosalicylate) and 5-sulfo-2-hydroxypotassium benzoate (5-potassium sulfosalicylate).

The black and white and the color developer composition may be added with the other developer component, for example, chelate, which is a suspension agent for calcium or magnesium or a stabilizer for the color developer. The chelate may be nitrilotriacetic acid, diethylenetriaminepentaacetic acid, ethylenediaminetetraacetic acid, N,N,N-trimethylenephosphonate, ethylenediamine-N,N,N',N'-tetramethylenesulfonate, ethylenediamine N,N-disuccinate, N,N-di (carboxylate)-L-asparatate, β-alanine disuccinate, 2-phosphonobutane-1,2,4-tricarboxylate, 1-hydroxyethylidene-1,1-diphosphonate, N,N'-bis (2-hydroxybenzyl) ethylenediamine-N,N'-diacetate or 1,2-dihydroxybenzenene-4, 6-dissulfonate. If necessary, two or more chelate may be used simultaneously.

The quantity of the chelate, which is added, must be determined to sufficiently hinder metal ions contained in the color developer. For example, the quantity is about 0.1 g/litter to 10 g/litter.

If necessary, an arbitrary development accelerator may be added to the developer composition. The development accelerator permitted to be added may be any one of the following materials: a thioehter compound disclosed in, for example, Japanese Patent Publication No. 37-16088, a p-phenylene diamine compound disclosed in Japanese Patent Laid-Open No. 52-49829, quaternary ammonium salt disclosed Japanese Patent Publication No. 44-30074, an amine compound disclosed in U.S. Pat. No. 2,494,903 and the like, polyalkylene oxide disclosed in Japanese Patent Publication No. 37-16088 and the like and 1-phenyl-3-pyrazolidone.

The developer composition may be added with an arbitrary anti-fogging agent. The anti-fogging agent may be the foregoing alkali metal halide or a heterocyclic compound containing nitrogen, such as an organic anti-fogging agent, for example, benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole, 2-thiazolylmethyl-benzimidazole, indazole, hydroxyazaindlidine or adenine.

If necessary, any one of the following surface active agents may be added: alkylsulfonic acid, arylsulfonic acid, aliphatic carboxylic acid or aromatic carboxylic acid.

Structure of Bleaching Agent Composition

The bleach composition may be a known bleaching agent. It is preferable that an organic complex salt (for example, a complex salt of aminopolycarboxylate) of iron (III), organic acid, such as citric acid, tartaric acid or malic acid, persulfate or peroxide is employed.

Among the foregoing materials, it is preferable that the organic complex salt of iron (III) is employed from viewpoints of realizing a quick process and prevention of contamination of the environment. Aminopolycarboxylic acid and its salt which is efficiently preparing the organic complex salt of iron (III) are as follows: ethylene diamine disuccinate (SS form), N-(2-carboxylate ethyl)-L-asparatate, β-alanine diacetate, methyliminodiacetate, ethylenediaminetetraacetic acid, diethylenetriaminepentaacetic acid, 1,3-diaminopropanetetraacetic acid, propyleneaminotetraacetic acid, nitrilotriacetic acid, cyclohexanediaminetetraacetic acid, iminodiacetic acid and glycoletherdiaminetetraacetic acid. The compound of each of the foregoing material may be any one of sodium, potassium, lithium or ammonia salt. Among the foregoing materials, it is preferable that any one of the following materials is employed: ethylene diamine disuccinate (SS form), N-(2-carboxylate ethyl)-L-asparatate, β-alanine diacetate, ethylenediaminetetraacetic acid, 1,3-diaminopropanetetraacetic acid and methyliminodiacetate. The reason for this is that its iron (III) complex salt has a satisfactory photographic characteristics. The foregoing ferric iron may be used in the form of the complex salt or it may be caused to form a ferric iron ion complex salt to be produced in solution by using ferric salt, such as ferric sulfate, ferric chloride, ferric acetate, ferric ammonium sulfate or ferric phosphate, and a chelate agent, such as aminopolycarboxylate. The chelate agent may be used in a quantity larger than the quantity required to produce ferric ion complex salt.

When the bleaching agent composition is used as the bleaching agent or the bleaching replenisher, alkali halide, such as potassium bromide or sodium bromide, which is a re-haloganating agent, is added together with the bleaching agent. When the bleaching agent composition is used as the bleaching-agent component, such as the bleaching fixer or bleaching fixing replenisher, the re-haloganating agent is not required.

Also a buffer is sometimes added. The addition of the buffer will be described later in the description about the fixer composition.

Structure of Fixer (Fixing Agent) Composition

The fixer composition is structured as follows: the fixer is a known fixer, that is, alkali metal salt or ammonia slat of thiosulfuric acid. Specifically, ammonium thiosulfate is employed, the degree of condensation of which can be raised.

To raise the fixing rate and prevent defective fixing, a sub-agent for dissolving halgenated silver may be added as a fixing assisting agent. The fixing assisting agent may be a water-soluble agent for dissolving halogenated silver, such as thiocyanate including sodium thiocyanate and ammonium thiocyanate, a thioether compound, such as ethylenbisthioglycol acid, 3,6-dithia-1,8-octainediol or thiourea. The foregoing material may solely be employed or two or more materials maybe mixed. When the fixing assisting agent is used, the quantity to be added is not higher than 50 mol %. It is preferable that the quantity is 30 mol % or lower. The lower limit of the quantity must be a quantity with which the effect of the additive can be obtained, the quantity being 0.2 mol % or higher.

The fixer and the bleaching fixing agent may contain a variety of fluorescent whiteners, anti-foaming agents, or surface active agents and organic solvent, such as polyvinyl pyrolidone or methanol.

It is preferable that the fixer and the bleaching fixing agent contains a preservative, such as a compound for discharging sulfurous acid ions, such as sulphite (for example, sodium sulfite, potassium sulfite, ammonium sulfite or the like), bisulfite (for example, ammonium bisulfite, sodium bisulfite, potassium bisulfite or the like), metha bisulfite (for example, methapotassium bisulfite, methasodium bisulfite, mehtaammonium bisulfite or the like) or aryl sulfonate, such as p-toluene sulfonate or m-carboxybenzene sulfinic acid. It is preferable that the quantity of the foregoing compounds is about 0.02 mol/liter to 1.0 mol/litter as a value converted into sulfurous acid ions or ions of sulfinic acid.

As the preservatives, ascorbic acid, carbonyl added with bisulfite or a carbonyl compound may be added.

If necessary, a buffer, a fluorescent bleaching agent, a chelate agent, an anti-foaming agent, a mildewproof agent and the like may be added.

Photosensitive Material

The photosensitive material which is a subject with which the photographic developing composition enclosed in the container according to the present invention is a general purpose black and white and color photosensitive material. Therefore, the container cleaning apparatus according to the present invention may be applied to a developing process of the photosensitive material for taking a picture, making a print, for use in a usual purpose, medical diagnosis, printing, as a color negative film, a color reversal film or a color photographic paper or for a usual purpose, movie and professional use.

The photosensitive material according to the present invention is a known and general purpose material. The structure, material and a technique for use have been disclosed in the following documents: Research Disclosure (hereinafter abbreviated as "RD") No. 17643 (December 1978), pp. 22 and 23, "I. Emulsion preparation and types" and No. 18716 (November 1979), pp. 648 of the same, No. 307105 (November 1989), pp. 863 to 865, P. Glafkides, Chemie et Phisique Photographique, Paul Montel, 1967), G. F. Duffin, Photographic Emulsion Chemistry, Focal Press, 1996) and V. L. Zelikman, et al., Making and Coaching Photographic Emulsion, Focal Press, 1964.

The preferred halogenate silver emulsion and the other materials (additives), a photographic structural layers (layer layout), a processing method for processing the foregoing photosensitive material and the additives for the process are those disclosed in Europe Patent EP 0,355,660A2, Japanese Patent Laid-Open No. 2-33144, Japanese Patent Laid-Open No. 62-215272 and the following table 1.

TABLE 1

| Type of Additives | RD17643 | RD18716 | RD307105 |
|---|---|---|---|
| 1. Chemical Sensitizer | pp. 23 | right-hand column of pp. 648 | pp. 866 |
| 2. Sensitivity Enhancer | | right-hand column of pp. 648 | |
| 3. Spectral Sensitization | pp. 23 to 24 | right-hand column of pp. 648 to right-hand column of pp. 649 | pp. 866 to pp. 868 |
| 4. Brightening Agent | pp. 24 | right-hand column of pp. 647 | pp. 868 |
| 5. Light Absorber Filter | pp. 26 and 26 | right-hand column of pp. 649 to left-hand column | pp 873 |

TABLE 1-continued

| Type of Additives | RD17643 | RD18716 | RD307105 |
|---|---|---|---|
| Dye, Ultraviolet Absorber | | of pp. 650 | |
| 6. Binder | pp. 26 | left-hand column of pp. 651 | pp. 873 to pp. 874 |
| 7. Plasticizer Lubricant | pp. 27 | right-hand column of pp. 650 | pp. 876 |
| 8. Application Agent | pp. 26 and 27 | right-hand column of pp. 650 | pp. 875 and 876 |
| 9. Static Preventing Agent | pp. 27 | right-hand column of pp. 650 | pp. 876 and 877 |
| 10 Matting Agent | | | pp 878 and 879 |

EXAMPLES

The structure and effect of the present invention will now be described such that examples are described. Note that the present invention is not limited to the following examples.

Example 1

Example 1 indicates the characteristics of the container and the cleaning effect of the present invention.

1. Cleaning Apparatus

Experiments were performed by using the apparatus for cleaning the portion for dissolving the replenisher integrated in the developing apparatus described with reference to FIGS. 1 to 7.

2. Container for Treatment Composition

As shown in Table 2, eleven types of containers made of different materials or having different physical properties were employed.

The shape of the container for the developer composition has a wide-mouthed container as schematically shown in FIG. 7. The specific dimensions and shape are as follows: the container is a prismatic bottle having a base formed into a square which has an inner diameter of 70 mm. The height of the columnar portion is 250 mm (height/base ratio was 3.6). The angle made between the surface of the bottom of the shoulder portion is 40°. The body of the container can be obtained by hollow molding, while the cap portion can be obtained by injection molding.

(3) Preparation of Developing Composition

A coloring developing composition composed of the following granular chemical components in quantities for each container was prepared. The composition was enclosed in each of the foregoing containers.

Preparation (Recipe) of Coloring Developing Composition

| | |
|---|---|
| Fluorescent whiting agent A (as follows) | 24.0 g |
| Fluorescent whiting agent B (as follows) | 24.0 g |
| Dimethylpolysiloxane surface active agent (silicon KF351A manufactured by Shin-etsu Chemical) | 0.70 g |
| Ethylenediaminetetraacetic acid | 30.0 g |
| Disodium-N,N-bis(sulfonateethyl) hydroxylamine | 60.0 g |
| Tri (isopropanol) amine | 20.0 g |
| Potassium hydroxide | 37.0 g |
| Sodium hydroxide | 48.0 g |

-continued

| | |
|---|---|
| Sodium sulfite | 1.20 g |
| Potassium bromide | 0.08 g |
| Polyethylene glycol 300 | 20.0 g |
| 4-amino-3-methyl-N-ethyl-N-(β-methanesulfoamideethyl) aniline.3/2 sulfuric acid solution.monohydlate | 120.0 g |
| potassium carbonate | 200.0 g |

A

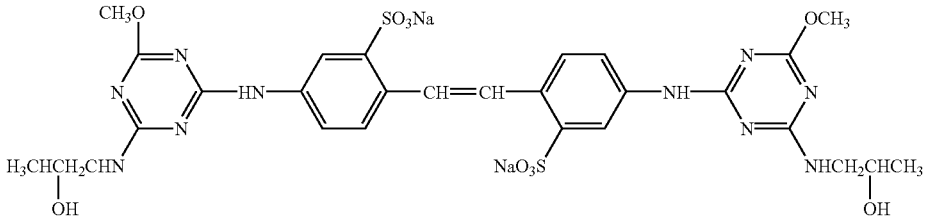

B

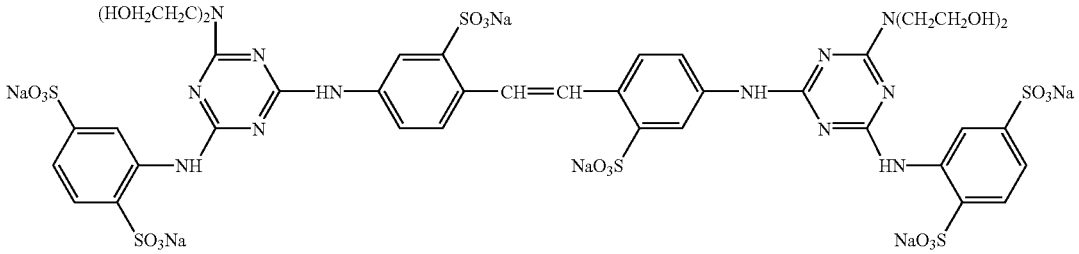

Granulation was performed as follows.

Granule 1

Fluorescent whitening agent A, fluorescent whitening agent B, the dimethylpolysiloxane surface active agent, disodium-N,N-bis (sulonateethyl) hydroxylamine, tri (isopropanol) amine and polyethylene glycol 300 in the foregoing quantities were mixed with one another and kneaded sufficiently. Then, the mixture is extruded from an extruding machine in a cold air flow to be formed a filament shape, followed by allowing the material to stand so as to be solidified. Then, the material was pulverized.

Granule 2

Potassium hydroxide, sodium hydroxide, sodium sulfite, potassium bromide and potassium carbonate in the foregoing quantities were dissolved in 700 ml water. Then, 10 ml of 1% solution of dextrine was added to mix the foregoing materials. Then, the mixture was sprayed from a spray drier into air, and then the mixture was dried. Thus, granules were obtained.

Granule 3

Granuled and marketed FCD-03 was employed as 4-amino-3-ethyl-N-ethyl-(β-methanesulfoamideethyl) aniline.3/2 sulfuric acid solution.monohydlate.

The three types of the granules were mixed so that the developer composition was prepared. The obtained material was enclosed in eleven types of containers in the above-mentioned quantities. After the treatment material was enclosed, the opening of each container was sealed with an aluminum plate on which a polyethylene (LDPE) was laminated by heat welding.

4. Method of Experiments

Time-Variation Test of Treatment Composition

Three samples of each of samples 1 to 11 enclosed in the containers were packed into accommodating cases in the form of corrugated cardboard boxes. Then, the samples were allowed to stand for 30 days in a thermo-hydrostat chamber set to a temperature of 40° C. and relative humidity of 70%. The time varying test approximated to the process from manufacture to start of use in the market was performed. The three containers accommodated in the accommodating case are three types of treatment materials constituting one treatment material kit. In this example, the color developer composition which was most hard to be cleaned among the compositions constituting the kit was enclosed.

Opening of Container and Discharge and Cleaning of Composition

The samples of the containers for the treatment composition subjected to the time-varying test were mounted on the portion for mounting the container for the treatment material shown in FIG. 2. In response to a control signal supplied from the control unit (460 shown in FIG. 4), the composition was discharged, followed by performing the operation for cleaning the inner wall of the container. That is, the container was moved downwards together with the holder so as be brought into contact with the opening and cleaning member (see FIG. 6). Thus, the blade member (190 shown in FIGS. 5 and 6) cut and opened the aluminum plate (308 shown in FIG. 6) so that the granulated composition in the container was discharged into the developer replenishing tank (347 shown in FIG. 4). After a lapse of one minute, cleaning water was sprayed from the cleaning nozzle (214 shown in FIGS. 5 and 6) into the inside portion of the container in a quantity of 40 ml in each spraying operation. The spraying operation was performed five times (the total quantity was 200 ml). The duration of one spraying operation was five seconds and intervals between two spraying operations was 15 seconds.

The opening at the leading end of the nozzle was opened in the conical shape having an upward angle of 30° from the vertical axis. The length of the tubular portion of the spraying operation was 5 mm. The water spraying pressure was 1.2 kg/cm$^2$.

Cleaning water was deionized water, the temperature of which was 25° C.

The empty container in the cartridge was removed from the treatment-material cartridge mounting portion of the automatic developing apparatus. Then, each of the containers was subjected to the following tests for evaluating the cleaning performance.

Observation and Evaluating Method

The evaluation of the performance for cleaning the container was performed such that (1) whether or not substances were allowed to adhere to the inner wall of the container was visually checked; and (2) 1000 ml deionized water was enclosed in the cleaned container, followed by allowing the container to stand at 40° C. for 24 hours. Then, the pH of water was measured and a state of coloring was observed. As the quantity of substances of the composition allowed to adhere to the inner wall of the container is enlarged, the pH is raised. Moreover, the residues are oxidized with air, causing coloring to be enhanced.

Results of the visual observation was evaluated with the following symbols ○, Δ and X.

○: no substances was allowed to adhere to the inner wall of the container, no residue was observed in the container and no color was detected.

Δ: at least one of the foregoing three factors encountered allowable problem.

X: one or more factors of the three factors encountered critical problems.

The given marks ○ and Δ are allowable results, while the mark X is a result which cannot be employed in a practical use.

As a matter of course, when the pH closes to neutral, that is, as the pH is lower, the results are satisfactory. If the pH is not higher than 8.9, the results are satisfactory.

The degree of coloring was indicated with the following symbols ○, Δ and X.

○: no color was detected.

Δ: slight coloring was detected.

X: excessive coloring was detected.

The criteria were as follows: the given marks ○ and Δ are allowable results, while the mark X is a result which cannot be employed in a practical use.

5. Results of Experiments

Table 2 shows results of the experiments together with the materials of the containers and characteristic values.

In table 2, superscript mark * indicates that the factor does not satisfy the scope of the present invention, while superscript mark + indicates that the factor satisfies the scope of the present invention or closes to the upper limit or the lower limit of the foregoing scope.

Experiment Nos. 3 to 7 performed by the cleaning method according to the present invention resulted in satisfactory cleaning performance in the three factors. The comparative example (experiment No. 1) in which the density of polyethylene was not higher than the lower limit of the scope of the present invention, the comparative example (experiment No. 8) in which the foregoing density was higher than the upper limit, the comparative example (experiment No. 2) in which the melt index was not higher than the lower limit of the scope of the present invention and the comparative example (experiment No. 9) in which the melt index was higher than the upper limit did not satisfy the allowable ranges of the three factors which must be evaluated. Therefore, the cleaning effect was unsatisfactory.

As for the material of the container, results of polyethylene terephthalate (indicated as "PET" in table 2) in experiment No. 10 and polyvinyl chloride (indicated as "PVC" in table 2) in experiment No. 11 contained results which did not satisfy the scope of the present invention. When the polyethylene container having the material, melt index and the density according to the present invention is cleaned by the cleaning apparatus according to the present invention, a satisfactory effect of cleaning can be obtained. If the characteristics including the material of the container do not satisfy the scope of the present invention, the effect of the present invention cannot be obtained in a state in which the cleaning operation according to the present invention is performed.

TABLE 2

| Experiment | Containers | | | Cleaning Effect | | | |
|---|---|---|---|---|---|---|---|
| No. | Material | Density (g/cm$^3$) | Melt Index (g/10 min) | Visual | pH | Coloring | Remarks |
| 1 | PE | 0.922* | 4.5 | X | 9.3 | X | comparative example |
| 2 | PE | 0.959 | 0.2* | X | 9.1 | X | comparative example |
| 3 | PE | 0.941+ | 1.5 | Δ | 8.3 | Δ | present invention |
| 4 | PE | 0.953 | 5.0+ | Δ | 8.0 | Δ | present invention |
| 5 | PE | 0.951 | 0.3 | Δ | 8.0 | Δ | present invention |
| 6 | PE | 0.957 | 1.6 | ○ | 7.3 | ○ | present invention |
| 7 | PE | 0.966+ | 1.4 | ○ | 7.8 | Δ | present invention |
| 8 | PE | 0.972* | 2.0 | X | 9.0 | X | comparative example |
| 9 | PE | 0.953 | 7.0* | X | 9.0 | X | comparative example |

TABLE 2-continued

| Experiment | Containers | | | Cleaning Effect | | | |
|---|---|---|---|---|---|---|---|
| No. | Material | Density ($g/cm^3$) | Melt Index (g/10 min) | Visual | pH | Coloring | Remarks |
| 10 | PET | 1.35 | | X | 9.3 | X | comparative example |
| 11 | PVC | 1.50 | | Δ | 8.3 | Δ | comparative example |

(note)
mark * indicates a characteristic value which does not satisfy the scope of the present invention, and mark + indicates a characteristic value close to the upper limit or the lower limit of the present invention.

Example 2

In example 2, the effect of the liquidity ratio of the HDPE which was the material of the container was evaluated by the cleaning method according to the present invention. Experiments were performed such that only the materials of the containers according to example 1 were changed as shown in table 3. The other conditions were the same as those of example 1. Also results of the experiments were shown in table 3.

Results of Experiments

Results of cleaning tests in experiment Nos. 21 to 23 satisfied the scope of the present invention. Each of a container (experiment No. 21) made of a material having a liquidity ratio of 18 and a container (experiment No. 23) made of a material having a liquidity ratio of 45 had pH slightly higher (0.2 pH) than that of a container (experiment No. 23) made of a material having a liquidity ratio of 23. Also the solutions were slightly colored. As a result, the polyethylene containers of a type having the liquidity ratio of 20 to 30 had excellent cleaning performance.

TABLE 3

| Experiment | Container | | | | Effect of Cleaning | | |
|---|---|---|---|---|---|---|---|
| No. | material | density ($g/cm^3$) | melt index (g/10 min) | liquidity ratio | visual | pH | coloring |
| 21 | PE | 0.956 | 0.7 | 18 | ○ | 7.5 | Δ |
| 22 | PE | 0.957 | 1.6 | 23 | ○ | 7.3 | ○ |
| 23 | PE | 0.959 | 0.6 | 45 | ○ | 7.5 | Δ |

Example 3

In example 3, the method of spraying of cleaning water was evaluated. The container used in experiment No. 6 according to example 1 was used and the methods of spraying cleaning water were changed as shown in Table 4. The method which was the same as that of example 1 was employed to perform experiments. Also results of the experiments are shown in table 4.

Results of Experiments

Experiment No. 31, in which the overall quantity of cleaning water, which was 200 ml, was sprayed in one spraying operation (for 25 seconds), experiment No. 32 in which spraying was performed three times (spraying for 8.3 seconds and pause for 5 seconds) and experiment No. 33 in which spraying was performed five times (spraying for 5 seconds and pause for 5 seconds) satisfied the scope of the present invention. However, the experiment (experiment No. 31) in which spraying was performed one time was inferior to two other experiments in all of the factors which were the visual observation, measurement in the pH and coloring of water. Therefore, the cleaning effect was improved as the number of spraying operations was increased. Therefore, it is preferable that the cleaning is performed in a division manner such that the quantity of cleaning water in one spraying operation is 50 ml or smaller. As a matter of course, if the quantity of water which is sprayed in one spraying operation is 5 ml or smaller, the number of spraying operations must considerably be increased. Therefore, the foregoing method is not a practical method. Moreover, if the interval between the spraying operations is shortened, it can be considered that the difference from the continuous cleaning operation is reduced.

TABLE 4

| Experiment | Cleaning Method (Quantity per operation and | Cleaning Effect | | |
|---|---|---|---|---|
| No. | number of spraying operation) | Visual | pH | coloring |
| 31 | 200 ml/operation, 1 time | Δ | 8.1 | Δ |
| 32 | 67 ml/operation, 3 times | ○ | 7.5 | Δ |
| 33 | 50 ml/operation, 4 time | ○ | 7.3 | ○ |

Example 4

In example 4, the type of the treatment composition was changed and the effect of the present invention was evaluated about the slurry developer composition condensed five times the developer replenisher for a color print having the following structure.

Structure of Developer Replenisher for Color Print

| | |
|---|---|
| ethylenediaminetetraacetic acid | 20 g |
| KOH (50 wt %) | 70 g |
| sodium sulfite | 1 g |
| triisopropanolamine (85 wt %) | 80 g |
| sodium bromide | 0.05 g |
| surface active agent (siloxane type) | 0.5 g |
| triazinyldiaminostilbene fluorescent whitener (Hakol FWA-SF manufactured by Showa) | 25 g |
| disodium-N,N-bis(sulfonateethyl)hydroxylamine | 55 g |
| 4,5-dihydroxybenzene-1,3-disodium sulfonate | 2.5 g |
| N-ethyl-N-(β-methanesulfoneamideethyl)-3-methyl-4-aminoaniline-3/2 sulfuric acid solution-monohydlate | 75 g (0.17 mol) |

-continued

| | |
|---|---|
| potassium carbonate | 130 g |
| overall quantity including water | 1000 ml |

The slurry composition obtained by condensing the developer replenisher for color print five times was prepared by a method called one powder component mixing method.

Triisopropanol amine and potassium hydroxide which were liquid components of the foregoing composition were previously added to 600 ml water for preparation. Then, the temperature was adjusted to 25° C., and then all of solid components were previously mixed while the components were being sufficiently stirred. Thus, a single component was realized which was added at a time. The temperature was controlled to 25° C. to 30° C. by water cooling. Water was added to the mixture solution formed into a suspension owing to the addition so that the quantity was made to be 1000 ml. As a result, a suspended composition having fluidity was obtained. The thus-prepared solutions were quickly enclosed in five types of polyethylene containers shown in table 5 such that the quantity of each solution was one litter. Then, a cap having an engaging thread and made of the same material was fitted, followed by sealing the opening with an aluminum sheet similarly to example 1.

The thus-prepared slurry developer compositions by the evaluation method employed in example 1 was evaluated to measure the effect of the container for the developer composition. Also results of the measurement are shown in table 5.

Results of Experiments

Table 5 shows the results together with the materials and characteristic values of the containers used in the experiments. Similarly to example 1, values each having superscript mark * shown in Table 5 indicates the factor which does not satisfy the scope of the present invention. Experiment No. 42 which was the cleaning method according to the present invention resulted excellent cleaning performance in the three factors. On the other hand, a comparative example (experiment No. 41) in which the density of polyethylene was lower than the lower limit of the scope of the present invention, a comparative example (experiment No. 43) in which the density was higher than the upper limit, a comparative example (experiment No. 44) in which the melt index was lower than the lower limit of the scope of the present invention and a comparative example (experiment No. 45) in which the melt index was higher than the upper limit did not satisfy the scopes of the present invention in the three factors. Thus, the cleaning effect was unsatisfactory.

Example 5

In example 5, the powder treatment composition was evaluated. A developer replenisher for X-ray film for medical diagnosis and fixer replenisher were prepared by using the opening and cleaning apparatus shown in FIG. 8. The contents were discharged from the containers into the dissolving tanks. Also cleaning water used to clean the containers were poured into the dissolving tanks. Then, required water was added so that the developer replenisher and the fixer replenisher were prepared. The opening and cleaning processes were performed as described above when the apparatus shown in FIG. 8 was described.

Developer Replenisher Composition

The solid composition for developer replenisher are as follows:

| | |
|---|---|
| sodium hydroxide (beads) 99.5% | 11.5 g |
| potassium sulfite (raw material) | 63.0 g |
| sodium sulfite (raw material) | 46.0 g |
| sodium carbonate | 62.0 g |
| hydroquenone (briquette) | 40.0 g |

The following powder components which were contained in small quantities were mixed so as to be formed into briquette.

| | |
|---|---|
| diethylenetriaminepentaacetic acid | 2.0 g |
| 5-methylbenzotriazole | 0.35 g |
| 4-hydroxymethyl-4-methyl-1-phenyl-3-pyrazolidone | 1.5 g |
| 2-mercaptobenzoimidazole-5-sodium sulfonate | 0.3 g |
| 3-(5-mercaptoterazole-1-il) sodium benzosulfonate | 0.1 g |
| sodium erisorbate | 6.0 g |

The foregoing quantities are quantity per litter. When the foregoing quantities are dissolved in water, the developer replenisher, the pH of which is 10.65 can be obtained.

The materials were used such that the raw material was used in the form of the usual industrial product, while the beads of the alkali metal salts were marketed products. The briquette were pulverized. The components which were used in small quantities were blended with one another, followed by granulating the blended materials.

The foregoing treatment material in a quantity of 10 litters was enclosed in the container, which was experiment No. 6

TABLE 5

| Experiment | Container | | melt index | Cleaning Effect | | | |
|---|---|---|---|---|---|---|---|
| No. | material | density (g/cm$^3$) | (g/10 min) | visual | pH | Coloring | Remarks |
| 41 | PE | 0.922* | 4.5 | X | 9.0 | X | comparative example |
| 42 | PE | 0.957 | 1.6 | ○ | 7.1 | ○ | present invention |
| 43 | PE | 0.972* | 2.0 | X | 9.1 | X | comparative example |
| 44 | PE | 0.959 | 0.2* | X | 9.0 | X | comparative example |
| 45 | PE | 0.953 | 7.0* | X | 8.9 | X | comparative example |

(note)
mark * indicates characteristic values which did not satisfy the scope of the present invention in example 1, which was made of dense polyethylene and which had the structure shown in FIG. 7. Then, the discharging opening was sealed with an aluminum and polyethylene laminated sheet.

The composition of the fixer composition for the fixer replenisher is as follows:

| | |
|---|---|
| Agent A (solid) | |
| ammonium thiosulfate (compact) | 125.0 g |
| sodium thiosulfate anhydride (raw material) | 19.0 g |
| sodium metabisulfite (raw material) | 18.0 g |
| acetic anhydride (raw material) | 42.0 g |
| Agent B (liquid) | |
| dihydrodisodiumethylenediaminetetraacetate | 0.03 g |
| citric acid anhydride | 3.7 g |
| sodium gluconate | 1.7 g |
| aluminum sulfate | 8.4 g |
| sulfuric acid | 2.1 g |

The foregoing quantities were those in one litter. When the foregoing quantities are dissolved in water, the fixer replenisher can be obtained, the pH of which is 4.65.

Ammonium thiosulfate (compact) was obtained by applying pressure to flakes manufactured by a spray dry method to be compressed by a roller compactor so as to be pulverized into monothilic chips having a size of about 4 mm to 6 mm. Then, the chips were blended with sodium hyposulfite anhydride. The other raw materials were usual industrial products.

Both of the agents A and B in a quantity of 10 litters were enclosed in the container which was the same as the container for the developer replenisher composition, which was made of high-density polyethylene and which has a shape as shown in FIG. 7. The discharging openings for the agents A and photographic treatment composition were sealed with aluminum and polyethylene laminated sheets. Moreover, a protective cap was added on the foregoing laminated sheet for the opening of the container for the agent B until the cap was removed.

4. Method of Experiments

The sample of the developer replenisher composition and that of the fixer replenisher composition were allowed to stand for 30 days in a thermo-hygrostat chamber set to a temperature of 40° C. and relative humidity of 70%. The time varying test was accelerated to be approximated to the "process from manufacture to start of use in the market" was performed.

Opening of Container and Discharge of Compositions and Cleaning

The container filled with the treatment material composition and subjected to the accelerated time varying process was opened to discharge the contents. Then, the container was cleaned, and then the contents were dissolved to prepare the replenisher. The foregoing process was performed by using the opening and cleaning apparatus shown in FIG. 8. When the sample of the container for the treatment material composition subjected to the time-varying process is mounted to the portion for mounting the container for the treatment material shown in FIG. 8, the blade 48 opens the container simultaneously with the mounting operation by the method described in the second embodiment about the opening and cleaning apparatus in this specification. Thus, the powder is downwards introduced into a replenishing tank (not shown) (also serving as the dissolving tank) disposed below mounting portion. Then, the cleaning member 346 provided with the cleaning nozzle 214 positioned in a lower position in a state shown in FIG. 8 is moved to an upper position so as to be introduced into the container 24. The cleaning member 346 is moved and stopped at the upper position (the columnar portion above the neck portion of the inverted container shown in FIG. 8 for 5 mm). Then, the electromagnetic valve for supplying cleaning water from a water storage tank (not shown) to the cleaning member is opened/closed so that the inside portion of the container was cleaned. The powder composition (a portion was in the form of liquid in a case of the fixer replenisher composition) is discharged to the corresponding replenishing tank also serving as the dissolving tank (not shown). After a lapse of one minute, cleaning water was sprayed to the inside portion of the container from the cleaning nozzle 214 such that an operation for spraying cleaning water in a quantity of 40 ml was performed 5 times (a total quantity of 200 ml). The duration of spraying was 5 second in each spraying operation. The interval between the spraying operations was 15 seconds.

The water-spray opening at the leading end of the nozzle was opened into a conical shape making an upward angle of 30° from the vertical axis. The length of the tubular portion of the spraying opening was 5 mm. The water spraying pressure was 1.2 kg/cm$^2$.

Cleaning water was deionized water, the temperature of which was 25° C.

The empty container was removed from the mounting portion of the opening and cleaning apparatus so as to be subjected to the evaluation test about the cleaning effect described in example 1.

5. Result of Experiments

The container in which the developer replenisher composition was accommodated resulted in satisfactory evaluation such that the visual observation and color were given mark ○ and pH was 7.7. The containers A and B in which the fixer replenisher composition was accommodated resulted in satisfactory evaluation such that both of the visual observation and coloring were given mark ○. The pH of the container A was 6.8, while the pH of the container B was 5.8. In a case of the acid composition, the allowable pH varies depending on the type of the composition. The resulted pH of the container A which was 6.8 was a neutral value. Therefore, the foregoing result was determined as a normal value. Moreover, the pH of the container B which was 5.8 is pH which indicated that the composition in the container B was diluted by at least two digits. Therefore, the foregoing pH was allowable value. The composition in the container B was a uniform solution which was not the subject of the present invention.

Example 6

In example 6, an influence of the shape of the container according to the present invention on the cleaning effect is examined. Note that the containers according to the present invention was compared with one another. HDPE which was the material of experiment No. 6 in example 1 was selected, the basic shape shown in FIG. 7 was employed, and the specific dimensions were changed as shown in table 6. Experiment No. 51 has the shape which was the preferred shape according to the present invention. Experiment Nos. 52 to 56 had the factors of the shapes thereof. The changed factors of the shapes were the length of the first side, the ratio of the columnar portion/the first side, the angle of inclination of the neck portion and the ratio of the second side/the first side. The capacities of the containers were substantially the same and the sizes were suitable to enclose the solid treatment material described in example 1. The container in experiment No. 51 had the size and shape described with reference to FIGS. 1 to 7 and suitable to a typical mini-lab. The experiments were performed by the same method as that employed in example 1 except for the factors of the shapes. Also results of the experiments were shown in table 6.

Results of Experiments

The container which was experiment No. 52 was a flat container having a small height and resulted in allowable values. However, all of the visual check, pH and coloring were inferior to those of the container which was experiment No. 51. The container having experiment No. 53 was an elongated container which resulted in allowable values. However, the cleaning effect was inferior to the container having the experiment No. 51 in the two factors which were pH and coloring. That is, the cleaning effect deteriorated if the shape was extended in the lateral direction from the optimum shape. Also in a case where the height was too large, the cleaning effect deteriorated. On the other hand, the containers having experiment Nos. 54 and 55 had a small inclination and steep inclination, respectively. The container having the gentle inclination easily encountered residue of the treatment composition in the container. The cleaning effect of the container having the steep inclination was somewhat unsatisfactory because of the high position of the bottom of the container (the bottom was positioned in an upper position in the inverted state). Also experiment No. 56 which had the ratio of the second side/the first side of the columnar portion which did not satisfy the optimum scope resulted in the unsatisfactory cleaning effect as compared with the optimum shape.

TABLE 6

| | Container | | | | | | |
|---|---|---|---|---|---|---|---|
| Experiment No. | long side | height/long side | angle of inclination | ratio of short side/long side | Cleaning Effect visual | pH | Coloring |
| 51 | 70 | 3.6 | 40 | 1.0 | ○ | 7.3 | ○ |
| 52 | $105^{+}$ | 2.0 | 40 | 1.0 | Δ | 8.2 | Δ |
| 53 | $60^{+}$ | $5.8^{+}$ | 40 | 1.0 | ○ | 8.5 | Δ |
| 54 | 70 | 3.6 | $10^{+}$ | 1.0 | ○ | 8.1 | Δ |
| 55 | 70 | 3.6 | $50^{+}$ | 1.0 | ○ | 7.8 | ○ |
| 56 | 85 | 3.1 | 40 | $0.65^{+}$ | Δ | 8.2 | Δ |

(note)
units of the long side is mm, units of the angle of inclination is degrees.
Superscript mark + indicated allowable value in the perspective view and deviation from the preferred range.

The method and apparatus for dissolving the photographic treatment composition according to the present invention has the steps of: mounting the container filled with the photographic treatment composition in the form of powder, granules, tablets or slurry and comprising as a resin only high-density polyethylene (HDPE) having a density of 0.941 to 0.969 g/cm$^3$ and a melt index of 0.3 g/10 min to 5.0 g/10 min; opening the opening of the container to inject the treatment composition into the dissolving tank; spraying cleaning water to the inside portion of the empty container from the nozzle to clean the container. Thus, the problems that the component of the treatment material are allowed to adhere to the inside wall of the container and coagulated substances allowed to adhere to the same can be prevented. Moreover, the inner wall of the container can sufficiently be cleaned.

Therefore, the structure of the present invention can be adapted to the system included in an automatic developing machine and arranged to automatically prepare the replenishers and clean the containers.

Although the invention has been described in its preferred form and structure with a certain degree of particularity, it is understood that the present disclosure of the preferred form can be changed in the details of construction and in the combination and arrangement of parts without departing from the spirit and the scope of the invention as hereinafter claimed.

What is claimed is:

1. A container containing a photographic treatment composition, which comprises:

an opening through which the photographic treatment composition is discharged;

a cover or a sealing member for closing the opening;

a bottom formed opposite to the opening;

a columnar portion sandwiched between the opening and the bottom to substantially accommodate the photographic treatment composition, the columnar portion having a substantially uniform cross-section throughout its height; and a shoulder portion for joining the columnar portion and the opening, wherein the container has a shape dimension that (1) a surface of projection of the columnar portion on the surface of the bottom is in the form of a rectangle or a square having a first side and a second side, the length of which first side is 40 mm to 100 mm and a ratio of the second side with respect to the first side is 0.7 to 1.0 or a circle having an inner diameter of 40 mm to 100 mm, (2) a ratio of the height of the columnar portion with respect to the first side or the inner diameter is 2.0 times to 4.0 times, and (3) an angle of inclination, which is an angle made from the surface of the bottom, of the shoulder portion made from the columnar portion to the opening is 15° to 45°, and wherein the container comprises as a resin, only high-density polyethylene (HDPE) having a density of 0.941 to 0.969 g/cm$^3$ and a melt index of 0.3 g/10 min to 5.0 g/10 min and the photographic treatment composition is a developing treatment composition, or a treatment composition having at least one of a bleaching function and a fixing function.

2. The container containing a photographic treatment composition according to claim 1 wherein the container comprises as a resin, only high-density polyethylene (HDPE) having a density of 0.951 to 0.969 g/cm$^3$ and a melt index of 0.3 g/10 min to 4.0 g/10 min.

3. A photographic treatment composition that is contained in a container, wherein the container comprises:

an opening through which the photographic treatment composition is discharged;

a cover or a sealing member for closing the opening;

a bottom formed opposite to the opening;

a columnar portion sandwiched between the opening and the bottom to substantially accommodate the photographic treatment composition, the columnar portion having a substantially uniform cross-section throughout its height; and a shoulder portion for joining the columnar portion and the opening, wherein the container has a shape dimension that (1) a surface of projection of the columnar portion on the surface of the bottom is in the form of a rectangle or a square having a first side and a second side, the length of which first side is 40 mm to 100 mm and a ratio of the second side with respect to the first side is 0.7 to 1.0 or a circle having an inner diameter of 40 mm to 100 mm, (2) a ratio of the height of the columnar portion with respect to the first side or the inner diameter is 2.0 times to 4.0 times, and (3) an angle of inclination, which is an angle made from the surface of the bottom, of the shoulder portion made from the columnar portion to the opening is 15° to 45°, and wherein the container comprises as a resin, only high-density polyethylene (HDPE) having a density of 0.951 to 0.969 g/cm$^3$ and a melt index of 0.3 g/10 min to 4.0 g/10 min and the photographic treatment composition is a developing treatment composition, or a treatment composition having at least one of a bleaching function and a fixing function.

4. The photographic treatment composition according to claim 3, wherein the container comprises as a resin, only high-density polyethylene (HDPE) having a density of 0.951 to 0.969 g/cm$^3$ and a melt index of 0.3 g/10 min to 4.0 g/10 min.

* * * * *